US006120983A

United States Patent [19]

Okada et al.

[11] Patent Number: 6,120,983

[45] Date of Patent: Sep. 19, 2000

[54] PHOTOTHERMOGRAPHIC MATERIAL, NOVEL 2,3-DIHYDROTHIAZOLE DERIVATIVE, AND PHOTOGRAPHIC SILVER HALIDE PHOTOSENSITIVE MATERIAL

[75] Inventors: Hisashi Okada; Ryo Suzuki; Naoki Asanuma; Tadashi Ikeda; Shigeo Hirano, all of Kanagawa, Japan

[73] Assignee: Fuji Photo Film Co., Ltd, Kanagawa, Japan

[21] Appl. No.: 08/956,134

[22] Filed: Oct. 22, 1997

[30] Foreign Application Priority Data

Oct. 22, 1996 [JP] Japan ..... 8-298154

[51] Int. Cl.[7] ..... G03C 1/498

[52] U.S. Cl. ..... 430/619; 430/264; 430/603; 430/611; 430/613; 430/614

[58] Field of Search ..... 430/619, 611, 430/614, 264, 603, 613

[56] References Cited

U.S. PATENT DOCUMENTS

| | | | |
|---|---|---|---|
| 4,500,626 | 2/1985 | Naito et al. . | |
| 4,607,006 | 8/1986 | Hirano et al. . | |
| 4,873,184 | 10/1989 | Simpson . | |
| 5,030,542 | 7/1991 | Nakamura et al. . | |
| 5,380,635 | 1/1995 | Gomez et al. . | |
| 5,409,809 | 4/1995 | Fabricius et al. | 430/611 |
| 5,654,130 | 8/1997 | Murray | 430/619 |
| 5,667,953 | 9/1997 | Bertoldi et al. | 430/611 |
| 5,672,469 | 9/1997 | Hioki et al. | 430/264 |
| 5,677,121 | 10/1997 | Tsuzuki . | |

FOREIGN PATENT DOCUMENTS

| | | |
|---|---|---|
| 0559228A1 | 9/1993 | European Pat. Off. . |
| 0829753A1 | 3/1998 | European Pat. Off. . |
| 2-4241A | 1/1990 | Japan . |
| 2211442 | 8/1990 | Japan . |
| 3-10391B2 | 2/1991 | Japan . |
| 3280038 | 11/1991 | Japan . |
| 4-182639 | 6/1992 | Japan . |
| 5-341432 | 12/1993 | Japan . |
| 6-194781 | 7/1994 | Japan . |
| 6-52387B2 | 7/1994 | Japan . |
| 6-301141 | 10/1994 | Japan . |
| 7-13295A | 1/1995 | Japan . |
| 8137043 | 5/1996 | Japan . |

*Primary Examiner*—Thorl Chea
*Attorney, Agent, or Firm*—Birch, Stewart Kolasch & Birch, LLP

[57] ABSTRACT

A photothermographic material contains an organic silver salt, a photosensitive silver halide, a reducing agent, a binder, and a compound of the formula: X—$L_1$—D wherein D is an electron donative group of atoms, X is an adsorption promoting group to silver halide, and $L_1$ is a valence bond or a linking group. It has high sensitivity in the red to infrared region and experiences a minimal change of photographic properties under different developing conditions.

11 Claims, No Drawings

PHOTOTHERMOGRAPHIC MATERIAL, NOVEL 2,3-DIHYDROTHIAZOLE DERIVATIVE, AND PHOTOGRAPHIC SILVER HALIDE PHOTOSENSITIVE MATERIAL

This invention relates to a novel 2,3-dihydrothiazole derivative and a photographic silver halide photosensitive material comprising the same. More particularly, it relates to a photothermographic material having high sensitivity and undergoing a minimal change of photographic performance under varying development conditions.

BACKGROUND OF THE INVENTION

From the contemporary standpoints of environmental protection and space saving, it is strongly desired to reduce the quantity of spent solution. Needed in this regard is a technology relating to thermographic photosensitive materials for use in medical diagnosis and general photography which can be effectively exposed by means of laser image setters and laser imagers and produce distinct black images having high resolution and sharpness. These thermographic photosensitive materials offer to the customer a simple thermographic system which eliminates a need for solution type chemical agents and is not detrimental to the environment.

On the other hand, the recent rapid progress of semiconductor laser technology has made it possible to reduce the size of medical image output devices. As a matter of course, there were developed techniques relating to infrared-sensitive photothermal silver halide photographic material which can utilize a laser diode as a light source. The spectral sensitization technique is disclosed, for example, in JP-B 10391/1991 and 52387/1994, JP-A 341432/1993, 194781/1994, and 301141/1994. The antihalation technique is disclosed, for example, in JP-A 13295/1995 and U.S. Pat. No. 5,380,635. Since the infrared exposure system permits the visible light absorption of sensitizing dyes and antihalation dyes to be considerably reduced, a substantially colorless photosensitive material can be readily produced.

A combination of the thermographic technology with the infrared exposure technology enables a photosensitive material which eliminates a need for liquid Since spectral sensitizing dyes capable of absorbing infrared radiation, however, generally have a high reducing power due to a high HOMO (highest occupied molecular orbital), they tend to reduce silver ions in photosensitive materials to exacerbate the fog thereof. In particular, these photosensitive materials experience a substantial change of performance during storage under hot humid conditions and long-term storage. If dyes having a low HOMO are used for preventing the photosensitive material from deteriorating during storage, spectral sensitization efficiency and sensitivity become low because their LUMO (lowest unoccupied molecular orbital) is relatively low. These problems relating to sensitivity, storage stability, and performance change arise not only with wet photographic photosensitive materials, but more outstandingly with photothermographic materials.

The supersensitization technique has been developed for overcoming such infrared sensitization problems. Known infrared supersensitizers for use in thermographic systems include aminopolycarboxylic acid derivatives as disclosed in JP-A 4241/1990, and heteroaromatic mercapto compounds and heteroaromatic disulfide compounds as disclosed in JP-A 182639/1992 and 341432/1993. The aminopolycarboxylic acid derivatives provide weak supersensitization effect and low sensitivity whereas the heteroaromatic mercapto and disulfide compounds allow photographic properties such as sensitivity and gradation to vary with changes of development temperature and time.

SUMMARY OF THE INVENTION

An object of the invention is to provide a photothermographic material which has high sensitivity in the red to infrared region, especially in the practically advantageous infrared region and undergoes a minimal change of photographic properties under varying development conditions.

Another object of the invention is to provide a novel compound capable of achieving the above object.

A further object of the invention is to provide a photographic silver halide photosensitive material comprising the novel compound.

In a first aspect of the present invention, there is provided a photothermographic material comprising (a) a reducible silver source, (b) a photocatalyst, (c) a reducing agent, (d) a binder, and (e) at least one compound of the following general formula (I):

$$X—L_1—D \quad (I)$$

wherein D is an electron donative group of atoms, with the proviso that where D is a hydrazino group which is not a part of a semicarbazido group, no oxo group is substituted to the carbon atom which is directly attached to a nitrogen atom of the hydrazine; X is a group capable of promoting adsorption to silver halide; and $L_1$ is a valence bond or a linking group. The electron donative group of atoms represented by D in formula (I) is preferably an amino group, a hydrazino group (except for a hydrazino group which is a part of a semicarbazido group, no oxo group is substituted to the carbon atom which is directly attached to a nitrogen atom of the hydrazine), a hydroxylamino group, a hydroxamic acid group, a semicarbazido group or a hydroxyl-semicarbazido group.

Preferably, the reducible silver source (a) is an organic silver salt, especially a silver salt of an organic acid, the photocatalyst (b) is a photosensitive silver halide and/or photosensitive silver halide-forming component; and the reducing agent (c) is a bisphenol. Also preferably, the photocatalyst (b) is spectrally sensitized in a wavelength region of 750 to 1,400 nm.

The photothermographic material may further contain (f) at least one hydrazine compound.

The compound of formula (I) is preferably added in an amount of $10^{-3}$ to 0.1 mol per mol of silver.

In a second aspect, the present invention provides a novel 2,3-dihydrothiazole derivative of the following general formula (II):

(II)

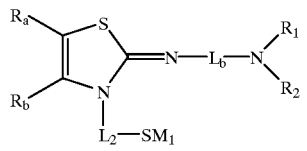

wherein each of $R_1$ and $R_2$ is a hydrogen atom, aliphatic hydrocarbon, aryl or heterocyclic group, $L_b$ is a valence bond or a linking group, $L_2$ is an alkylene group, each of $R_a$ and $R_b$ is a hydrogen atom or monovalent substituent group, and $M_1$ is a hydrogen atom or cation, $R_a$ and $R_b$, and $R_1$ and $R_2$ may form a ring, taken together.

Also contemplated herein is a photographic silver halide photosensitive material comprising at least one 2,3-dihydrothiazole derivative of formula (II) which is preferably a photothermographic material.

DESCRIPTION OF THE PREFERRED EMBODIMENTS

According to the invention, the thermographic photosensitive material contains a compound of the general formula (I). The inclusion of this compound ensures sufficient supersensitization effect in the red to infrared region, especially in the practically advantageous infrared region and suppresses a change of sensitivity and other photographic properties under varying development conditions. When the photosensitive material further contains a hydrazine derivative, high contrast images are obtained and a change of gradation under different development conditions is minimized.

The compound of general formula (I) is described in detail.

$$X—L_1—D \quad (I)$$

D is an electron donative group of atoms. The electron donative group of atoms represented by D is a group of atoms containing at least one of carbon, nitrogen, oxygen and sulfur atoms. Exemplary electron donative groups include amino groups, groups complying with Kendall-Pelz rule, and monovalent groups derived from metal salts or metal complexes (e.g., pherocenes), and combinations thereof. The groups complying with Kendall-Pelz rule are, for example, a hydrazino group (except for a hydrazino group which is a part of a semicarbazido group, no oxo group is substituted to the carbon atom which is directly attached to a nitrogen atom of the hydrazine), a hydroxylamino group, a hydroxamic acid group, a semicarbazido group, and a hydroxyl-semicarbazido group as well as monovalent groups derived from hydroquinones, pyrocatechols, o-aminophenols, p-aminophenols, o-phenylenediamines, p-phenylenediamines, ascorbic acids, hydroxytetronic acids, α-ketols, α-aminoketones, hydrocoerulignones, and hydrazones.

The electron donative group of atoms represented by D may have a substituent. Exemplary substituents include alkyl groups inclusive of cycloalkyl and aralkyl groups, preferably having 1 to 20 carbon atoms, more preferably 1 to 12 carbon atoms, most preferably 1 to 8 carbon atoms, for example, methyl, ethyl, n-propyl, iso-propyl, n-butyl, tert-butyl, n-heptyl, n-octyl, n-decyl, n-undecyl, n-hexadecyl, cyclopropyl, cyclopentyl, cyclohexyl, benzyl, and phenethyl; alkenyl groups, preferably having 2 to 20 carbon atoms, more preferably 2 to 12 carbon atoms, most preferably 2 to 8 carbon atoms, for example, vinyl, allyl, 2-butenyl, and 3-pentenyl; alkynyl groups, preferably having 2 to 20 carbon atoms, more preferably 2 to 12 carbon atoms, most preferably 2 to 8 carbon atoms, for example, propargyl and 3-pentynyl; aryl groups, preferably having 6 to 30 carbon atoms, more preferably 6 to 20 carbon atoms, most preferably 6 to 12 carbon atoms, for example, phenyl, p-methylphenyl, and naphthyl; amino groups, preferably having 0 to 20 carbon atoms, more preferably 0 to 10 carbon atoms, most preferably 0 to 6 carbon atoms, for example, amino, methylamino, dimethylamino, diethylamino, and dibenzylamino; alkoxy groups, preferably having 1 to 20 carbon atoms, more preferably 1 to 12 carbon atoms, most preferably 1 to 8 carbon atoms, for example, methoxy, ethoxy, and butoxy; aryloxy groups, preferably having 6 to 20 carbon atoms, more preferably 6 to 16 carbon atoms, most preferably 6 to 12 carbon atoms, for example, phenyloxy and 2-naphthyloxy; acyl groups, preferably having 1 to 20 carbon atoms, more preferably 1 to 16 carbon atoms, most preferably 1 to 12 carbon atoms, for example, acetyl, benzoyl, formyl, and pivaloyl; alkoxycarbonyl groups, preferably having 2 to 20 carbon atoms, more preferably 2 to 16 carbon atoms, most preferably 2 to 12 carbon atoms, for example, methoxycarbonyl and ethoxycarbonyl; aryloxy groups, preferably having 7 to 20 carbon atoms, more preferably 7 to 16 carbon atoms, most preferably 7 to 10 carbon atoms, for example, phenyloxycarbonyl; acyloxy groups, preferably having 2 to 20 carbon atoms, more preferably 2 to 16 carbon atoms, most preferably 2 to 10 carbon atoms, for example, acetoxy and benzoyloxy; acylamino groups, preferably having 2 to 20 carbon atoms, more preferably 2 to 16 carbon atoms, most preferably 2 to 10 carbon atoms, for example, acetylamino and benzoylamino; alkoxycarbonylamino groups, preferably having 2 to 20 carbon atoms, more preferably 2 to 16 carbon atoms, most preferably 2 to 12 carbon atoms, for example, methoxycarbonylamino; aryloxycarbonylamino groups, preferably having 7 to 20 carbon atoms, more preferably 7 to 16 carbon atoms, most preferably 7 to 12 carbon atoms, for example, phenyloxycarbonylamino; sulfonylamino groups, preferably having 1 to 20 carbon atoms, more preferably 1 to 16 carbon atoms, most preferably 1 to 12 carbon atoms, for example, methanesulfonylamino and benzenesulfonylamino; sulfamoyl groups, preferably having 0 to 20 carbon atoms, more preferably 0 to 16 carbon atoms, most preferably 1 to 12 carbon atoms, for example, sulfamoyl, methylsulfamoyl, dimethylsulfamoyl, and phenylsulfamoyl; carbamoyl groups, preferably having 1 to 20 carbon atoms, more preferably 1 to 16 carbon atoms, most preferably 1 to 12 carbon atoms, for example, carbamoyl, methylcarbamoyl, diethylcarbamoyl, and phenylcarbamoyl; alkylthio groups, preferably having 1 to 20 carbon atoms, more preferably 1 to 16 carbon atoms, most preferably 1 to 12 carbon atoms, for example, methylthio and ethylthio; arylthio groups, preferably having 6 to 20 carbon atoms, more preferably 6 to 16 carbon atoms, most preferably 6 to 12 carbon atoms, for example, phenylthio; sulfonyl groups, preferably having 1 to 20 carbon atoms, more preferably 1 to 16 carbon atoms, most preferably 1 to 12 carbon atoms, for example, mesyl and tosyl; sulfinyl groups, preferably having 1 to 20 carbon atoms, more preferably 1 to 16 carbon atoms, most preferably 1 to 12 carbon atoms, for example, methanesulfinyl and benzenesulfinyl; ureido groups, preferably having 1 to 20 carbon atoms, more preferably 1 to 16 carbon atoms, most preferably 1 to 12 carbon atoms, for example, ureido, methylureido, and phenylureido; phosphoric amide groups, preferably having 1 to 20 carbon atoms, more preferably 1 to 16 carbon atoms, most preferably 1 to 12 carbon atoms, for example, diethylphosphoric amide and phenylphosphoric amide; hydroxy group; mercapto group; halogen atoms such as fluorine, chlorine, bromine and iodine atoms; cyano group; sulfo group; sulfino group; carboxyl group; phosphono group; phosphino group; nitro group; hydroxamic acid group; hydrazino group; imino group; and heterocyclic groups such as imidazolyl, pyridyl, furyl, piperidyl, and morpholino. Among the foregoing groups, those groups capable of forming a salt such as hydroxy, mercapto, sulfo, sulfino, carboxyl, phosphono, and phosphino groups may take the form of a salt. These substituents may be further substituted. Where there are two or more substituents, they may be identical or different.

Preferred substituents are alkyl, alkenyl, aralkyl, aryl and heterocyclic groups. More preferred are alkyl, aralkyl, aryl and heterocyclic groups. Alkyl groups are most preferred substituents.

The electron donative group of atoms represented by D is preferably an amino group, a hydrazino group (except for a hydrazino group which is a part of a semicarbazido group, no oxo group is substituted to the carbon atom which is directly attached to a nitrogen atom of the hydrazine), a hydroxylamino group, a hydroxamic acid group, a semicarbazido group or a hydroxylsemicarbazido group. More preferred are amino, hydrazino, and semicarbazido groups. Further preferred is a group of atoms represented by the following general formula (D-1), (D-2) or (D-3).

(D-1)

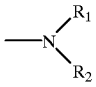

(D-2)

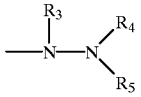

(D-3)

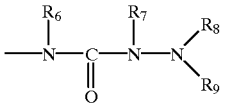

In the formulae, each of $R_1$, $R_2$, $R_3$, $R_4$, $R_5$, $R_6$, $R_7$, $R_8$, and $R_9$ is a hydrogen atom, aliphatic hydrocarbon group, aryl group or heterocyclic group.

The aliphatic hydrocarbon groups represented by $R_1$ to $R_9$ include normal, branched or cyclic alkyl groups, preferably having 1 to 30 carbon atoms, more preferably 1 to 20 carbon atoms, most preferably 1 to 12 carbon atoms, for example, methyl, ethyl, n-propyl, iso-propyl, n-butyl, tert-butyl, n-heptyl, n-octyl, n-decyl, n-undecyl, n-hexadecyl, cyclopropyl, cyclopentyl, and cyclohexyl; alkenyl groups, preferably having 2 to 30 carbon atoms, more preferably 2 to 20 carbon atoms, most preferably 2 to 12 carbon atoms, for example, vinyl, allyl, 2-butenyl, and 3-pentenyl; and alkynyl groups, preferably having 2 to 30 carbon atoms, more preferably 2 to 20 carbon atoms, most preferably 2 to 12 carbon atoms, for example, propargyl and 3-pentynyl, with the alkyl groups being preferred.

The aryl groups represented by $R_1$ to $R_9$ include monocyclic or bicyclic aryl groups, preferably having 6 to 30 carbon atoms, for example, phenyl and naphthyl. More preferred are phenyl groups having 6 to 20 carbon atoms, especially 6 to 12 carbon atoms.

The heterocyclic groups represented by $R_1$ to $R_9$ include 3- to 10-membered, saturated or unsaturated heterocyclic groups containing at least one of nitrogen (N), oxygen (O), sulfur (S), and selenium (Se), which may be monocyclic or form a fused ring with another ring.

Preferred heterocyclic groups are 5- or 6-membered aromatic heterocyclic groups, more preferably 5- or 6-membered aromatic heterocyclic groups containing a nitrogen atom, further preferably 5- or 6-membered aromatic heterocyclic groups containing one or two nitrogen atoms.

Illustrative examples of the heterocyclic group include monovalent groups derived from pyrrolidine, piperidine, piperazine, morpholine, thiophene, furan, pyrrole, imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzothiazole, benzoselenazole, benzotriazole, and tetraazaindene. Preferred heterocyclic groups are monovalent groups derived from thiophene, furan, pyrrole, imidazole, pyrazole, pyridine, pyrazine, pyridazine, indole, indazole, thiadiazole, oxadiazole, quinoline, phthalazine, quinoxaline, quinazoline, cinnoline, thiazole, oxazole, benzimidazole, benzoxazole, and benzothiazole. More preferred are monovalent groups derived from thiophene, furan, imidazole, and pyridine. The monovalent group derived from pyridine is most preferred.

The aliphatic hydrocarbon, aryl and heterocyclic groups represented by $R_1$ to $R_9$ may have a substituent which is as exemplified for the substituent on D.

Alternatively, $R_1$ and $R_2$, $R_3$ and $R_4$, $R_4$ and $R_5$, $R_6$ and $R_7$, $R_7$ and $R_8$, and $R_8$ and $R_9$, taken together, may form a ring. The preferred rings Rs form are 5- to 8-membered nitrogenous heterocycles, more preferably 5- or 6-membered nitrogenous saturated heterocycles. Exemplary rings include pyrrolidine, piperidine, piperazine, morpholine, pyrroline, imidazoline, imidazolidine, pyrazolidine, pyrazoline, indoline, isoindoline, perhydroxyazepine, and hexahydropyridazine.

Each of $R_1$ and $R_2$ is preferably a hydrogen atom, aliphatic hydrocarbon or aryl group, more preferably hydrogen, alkyl or phenyl, most preferably alkyl. Also preferably, $R_1$ and $R_2$, taken together, form a nitrogenous saturated heterocycle, preferred examples of which are pyrrolidine, piperidine, and morpholine.

Each of $R_3$, $R_4$, and $R_5$ is preferably an aliphatic hydrocarbon or aryl group, more preferably alkyl or phenyl, most preferably alkyl. Also preferably, $R_3$ and $R_4$, or $R_4$ and $R_5$, taken together, form a nitrogenous saturated heterocycle. Preferred examples of the ring formed by $R_3$ and $R_4$ are pyrazolidine, hexahydropyridazine, and 2,3-diazabicyclo-[2.2.1]heptane. Preferred examples of the ring formed by $R_4$ and $R_5$ are pyrrolidine, piperidine, azepane (perhydroxyazepine) and azokane, with the pyrrolidine and piperidine being more preferred.

Each of $R_6$ and $R_7$ is preferably a hydrogen atom, aliphatic hydrocarbon or aryl group, more preferably hydrogen, alkyl or phenyl, further preferably hydrogen or alkyl, most preferably hydrogen.

Each of $R_8$ and $R_9$ is preferably a hydrogen atom, aliphatic hydrocarbon or aryl group, more preferably hydrogen, alkyl or phenyl, most preferably hydrogen or alkyl. Also preferably, $R_8$ and $R_9$, taken together, form a nitrogenous saturated heterocycle, preferred examples of which are pyrrolidine and piperidine. Most preferably, $R_8$ and $R_9$ are hydrogen.

In formula (I), X is a group capable of promoting adsorption to silver halide. The adsorption promoting group represented by X is a group containing at least one atom of carbon (C), nitrogen (N), oxygen (O), sulfur (S), and selenium (Se). Exemplary are thioamides (inclusive of cyclic and acyclic thioamides), thioureas, thiosemicarbazides (e.g., 4-thiazoline-2-thion, 4-imidazoline-2-thion, 2-thiohydantoin, rhodanine, thiobarbituric acid, 1,2,4-triazoline-3-thion, 1,3,4-oxazoline-2-thion, benzimidazoline-2-thion, benzoxazoline-2-thion, benzothiazolidine-2-thion, thiotriazine, and 1,3-imidazoline-2-thion), mercapto groups (inclusive of aliphatic mercapto groups and aromatic mercapto groups), heterocyclic mercapto groups (Where a nitrogen atom adjoins the carbon atom to which —SH group is attached, they are of the same definition as the thioamide groups in tautomerism therewith. Examples of such group are the same as mentioned above. Preferred examples of the heterocyclic mercapto group are 5- or 6-membered nitrogenous aromatic heterocyclic mercapto groups such as mercaptotetrazole, mercaptotriazole, mercaptoimidazole, mercaptothiazole, mercaptothiadiazole, mercaptooxazole, mercaptooxadiazole, mercaptobenzothiazole, mercaptobenzoxazole, mercaptobenzimidazole, mercaptobenzoselenazole, mercaptopyrimidine, and mercaptotriazine.), disulfide groups (inclusive of aliphatic disulfides, aromatic disulfides, and heterocyclic disulfides), thioether groups (inclusive of aliphatic thioethers, aromatic thioethers, and heterocyclic thioethers), nitrogenous heterocycles (preferably 5- or 6-membered aromatic heterocycles, such as benzotriazole, triazole, tetrazole, indazole, benzimidazole, imidazole, benzothiazole, thiazole, thiazoline, benzoxazole, oxazole, oxazoline, thiadiazole, oxathiazole, triazine, and azaindene), and quaternary nitrogenous heterocyclic salts (e.g., benzothiazolium, benzoxazolium, and benzoimidazolium).

The adsorption promoting group to silver halide represented by X may have a substituent, which is as exemplified for the substituent on D.

Preferably, the adsorption promoting group to silver halide represented by X is a thioamide or mercapto group, more preferably a mercapto group, further preferably a heterocycle-substituted alkylmercapto group, especially an alkylmercapto group having a 2,3-dihydrobenzothiazole skeleton as a substituent.

In formula (I), $L_1$ is a valence bond or a divalent or trivalent linking group. Where $L_1$ is a trivalent linking group, one chain end of $L_1$ to be attached to D or X forms a divalent group (e.g., ═N—) obtained by eliminating two hydrogen atoms from the atom at the chain end.

The divalent or trivalent linking group represented by $L_1$ is at least one atom of carbon, nitrogen, sulfur, and oxygen or a group of atoms containing such an atom. Examples include alkylene, alkenylene, alkynylene, arylene, divalent heterocyclic, —O—, —S—, —N($R_{01}$)—, —N═, —CO—, —$SO_2$—, alone or in admixture of two or more wherein $R_{01}$ is hydrogen or a hydroxy, aliphatic hydrocarbon, aryl or heterocyclic group. If possible, these groups may have a substituent, which is as exemplified for the substituent on D.

Examples of the divalent or trivalent linking group represented by $L_1$ are given below.

—$CH_2$—, —$CH_2CH_2$—, —$CH_2CH_2CH_2$—,

—$CH_2CH$(—$CH_3$)—, H, ,

, ,

—$CH_2$, N,

—$CH_2CH_2OCH_2CH_2$—, —$CH_2CH_2SCH_2CH_2$—,

—$SCH_2CH_2$—, —$CH_2CH_2NHCH_2CH_2$—,

═N—$CH_2CH_2$—, ═N—$CH_2CH_2CH_2$—,

-continued

—CNH$CH_2$—, —CNH$CH_2CH_2$—,

—CNH, —CNH,

—CNH, —NHCNH$CH_2$—,

—NHCNH—$CH_2CH_2$—, —NHCNH$CH_2CH_2CH_2$—

—NHCNH, —NHCNH,

—NHCNH,

—$NHSO_2$, —$NHSO_2$,

—$NHSO_2$, —NHC$CH_2CH_2$—,

—NHC, —NHC,

—NHC, ═N,

═N, ═N,

═N, NHCNH—$(CH_2)_3$—,

═N, NHCNH—$(CH_2)_2$

═N, CONH$CH_2CH_2$—,

—$CH_2$CNH$CH_2CH_2$—,

-continued

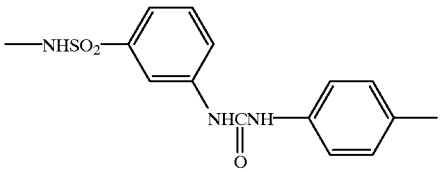

Where D is an amino or hydrazino group, $L_1$ is preferably a divalent or trivalent linking group.

Preferred among the compounds of formula (I) are compounds of the following general formula (I-a):

(I-a)

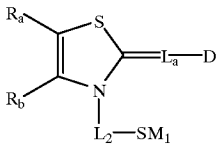

wherein D is as defined in formula (I), with its preferred range being the same, $L_a$ is a valence bond or a divalent or trivalent linking group, $L_2$ is an alkylene group, each of $R_a$ and $R_b$ is a hydrogen atom or monovalent substituent group, and $M_1$ is a hydrogen atom or cation.

The divalent or trivalent linking group represented by $L_a$ is at least one atom of carbon, nitrogen, sulfur, and oxygen or a group of atoms containing such an atom. Examples include alkylene, alkenylene, alkynylene, arylene, divalent heterocyclic, —O—, —S—, —N($R_{02}$)—, —N=, —CO—, —$SO_2$—, alone or in admixture of two or more wherein $R_{02}$ is hydrogen or a hydroxy, aliphatic hydrocarbon, aryl or heterocyclic group. If possible, these groups may have a substituent, which is as exemplified for the substituent on D. Preferably, the divalent or trivalent linking group represented by $L_a$ is a linking group consisting of =N— combined with an alkylene group (inclusive of normal, branched and cyclic ones, preferably having 2 to 6 carbon atoms, more preferably 2 to 4 carbon atoms, further preferably 2 or 3 carbon atoms), =N— combined with an arylene group (preferably having 6 to 20 carbon atoms, more preferably 6 to 16 carbon atoms, further preferably 6 to 12 carbon atoms), or =N— combined with an aralkylene group (preferably having 7 to 20 carbon atoms, more preferably 7 to 16 carbon atoms, further preferably 7 to 12 carbon atoms), with the linking group consisting of =N— and an alkylene group being more preferred. Examples of the alkylene, arylene and aralkylene include ethylene, trimethylene, propylene, tetramethylene, pentamethylene, hexamethylene, 1,2-cyclohexylene, phenylene, naphthylene, and xylylene. Ethylene, trimethylene, and propylene are preferred, with the ethylene and trimethylene being especially preferred.

The alkylene group represented by $L_2$ may be normal, branched or cyclic and preferably has 2 to 6 carbon atoms, more preferably 2 to 4 carbon atoms, further preferably 2 or 3 carbon atoms. The alkylene group may have a substituent, which is as exemplified for the substituent on D. Preferred examples of the alkylene group include ethylene, trimethylene, propylene, tetramethylene, and 1,2-cyclohexylene. Ethylene, trimethylene, and propylene are more preferred, with the ethylene and propylene being further preferred. Ethylene is the most preferred alkylene group.

The substituent groups represented by $R_a$ and $R_b$ are as exemplified for the substituent on D. Preferred substituent groups are alkyl, aralkyl, aryl groups and halogen atoms, with the alkyl and aryl groups being more preferred. Alternatively, $R_a$ and $R_b$, taken together, may form a ring, examples of which include unsaturated hydrocarbon rings (e.g., cyclopentene and cyclohexene) and unsaturated heterocycles (e.g., pyridine, pyrimidine, and pyrazole). Of these, aromatic hydrocarbon rings and aromatic heterocycles are preferred, and aromatic hydrocarbon rings are more preferred, with a benzene ring being most preferred.

Preferably, each of $R_a$ and $R_b$ is a hydrogen atom, an alkyl or aryl group, or $R_a$ and $R_b$, taken together, form an aromatic hydrocarbon ring. More preferably, each of $R_a$ and $R_b$ is a hydrogen atom, an alkyl or aryl group, or $R_a$ and $R_b$, taken together, form a benzene ring. Further preferably, $R_a$ and $R_b$, taken together, form a benzene ring.

The cation represented by $M_1$ is selected from organic and inorganic cations, for example, alkali metal ions such as $Li^+$, $Na^+$, $K^+$, and $Cs^+$, alkaline earth metal ions such as $Ca^{2+}$ and $Mg^{2+}$, ammonium ions such as ammonium and tetrabutylammonium, pyridinium ion, and phosphonium ions such as tetrabutylphosphonium and tetraphenylphosphonium. Preferably, $M_1$ is a hydrogen atom or alkali metal ion, with the hydrogen being most preferred.

More preferred among the compounds of formula (I) are compounds of the following general formula (I-b):

(I-b)

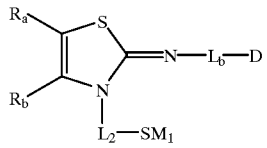

wherein D is as defined in formula (I), with its preferred range being the same, $R_a$, $R_b$, $M_1$, and $L_2$ are as defined in formula (I-a), with their preferred range being the same, and $L_b$ is a divalent or trivalent linking group containing at least one carbon atom.

The divalent or trivalent linking group represented by $L_b$ is an alkylene group, an arylene group or a combination of such a group with —O—, —S—, —N($R_{03}$)—, —N=, —CO— or —$SO_2$— wherein $R_{03}$ is hydrogen or a hydroxy, aliphatic hydrocarbon, aryl or heterocyclic group. Preferably, $L_b$ is a divalent linking group. The preferred divalent linking groups represented by $L_b$ include alkylene groups which may be normal, branched or cyclic and preferably have 2 to 8 carbon atoms, more preferably 2 to 6 carbon atoms, most preferably 2 or 3 carbon atoms and arylene groups which preferably have 6 to 18 carbon atoms, more preferably 6 to 16 carbon atoms, further preferably 6 to 12 carbon atoms. Illustrative examples of the divalent linking group include ethylene, trimethylene, propylene, tetramethylene, pentamethylene, hexamethylene, 1,2-cyclohexylene, phenylene, and naphthylene. Ethylene, trimethylene, propylene, and tetramethylene are preferred, with the ethylene and trimethylene being especially preferred.

Further preferred among the compounds of formula (I) are compounds of the following general formula (II):

(II)

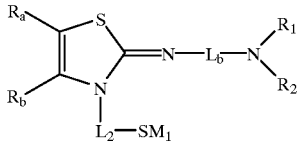

wherein $R_1$ and $R_2$ are as defined in formula (D-1), with their preferred range being the same, $R_a$, $R_b$, $M_1$, and $L_2$ are as defined in formula (I-a), with their preferred range being the same, and $L_b$ is a valence bond or is as defined in formula (I-b), with its preferred range being the same.

Still further preferred among the compounds of formula (I) are compounds of the following general formula (II-a):

(II-a)

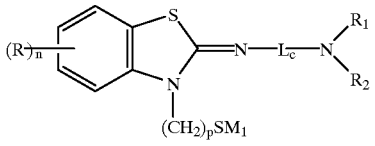

In formula (II-a), $R_1$ and $R_2$ are as defined in formula (D-1), with their preferred range being the same. $M_1$ is as defined in formula (I-a), with its preferred range being the same. $L_c$ is an alkylene group. R is a monovalent substituent group. Letter n is an integer of 0 to 4, and p is an integer of 2 to 4.

The alkylene group represented by $L_c$ may be normal, branched or cyclic and preferably have 2 to 6 carbon atoms, more preferably 2 to 4 carbon atoms, most preferably 2 or 3 carbon atoms. Illustrated examples of the alkylene group include ethylene, trimethylene, propylene, tetramethylene, pentamethylene, hexamethylene, and 1,2-cyclohexylene. Ethylene, trimethylene, propylene, and tetramethylene are preferred, with ethylene, trimethylene and propylene being more preferred. Ethylene and trimethylene are especially preferred.

The substituent group represented by R is as exemplified for the substituent on D. Preferred substituent groups are alkyl, aralkyl, aryl groups and halogen atoms, with the alkyl and aryl groups being more preferred.

Letter n is preferably an integer of 0 to 2, more preferably 0 or 1, further preferably 0. Letter p is preferably equal to 2 or 3, more preferably 2.

Illustrative, non-limiting examples of the compound of formula (I) are given below.

1.

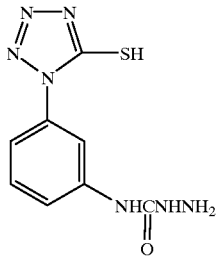

2.

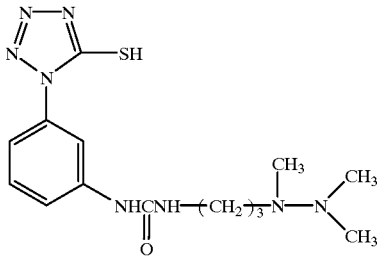

3.

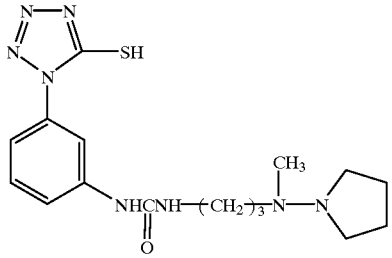

4.

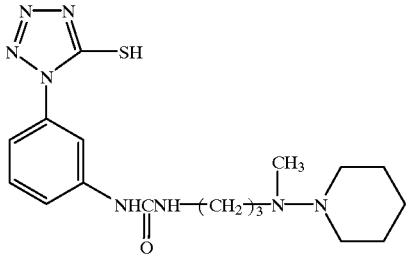

5.

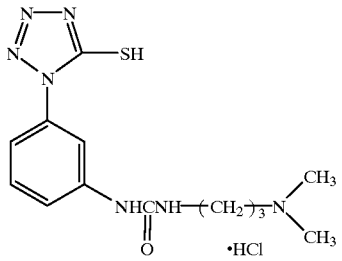

6.

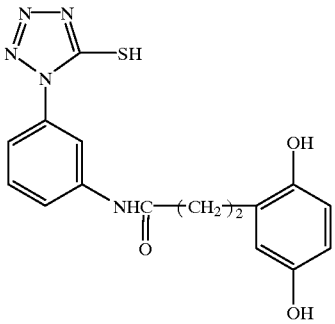

-continued
7.
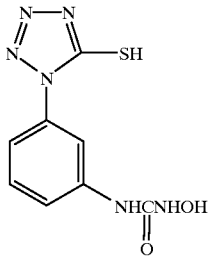
8.
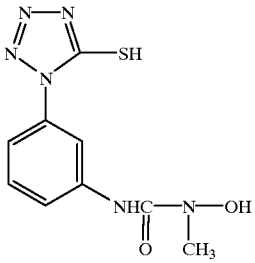
9.
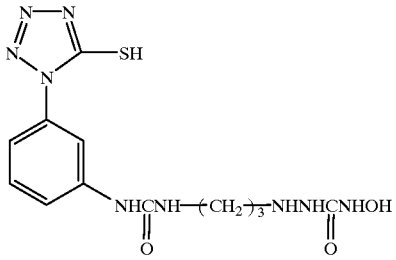
10.
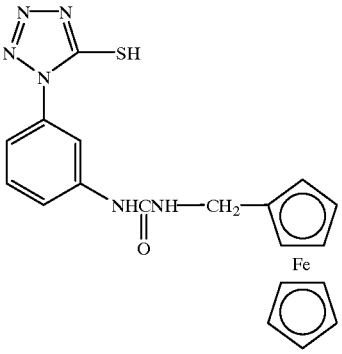
11.
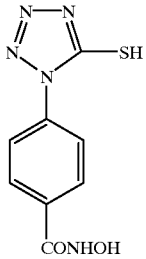
12.
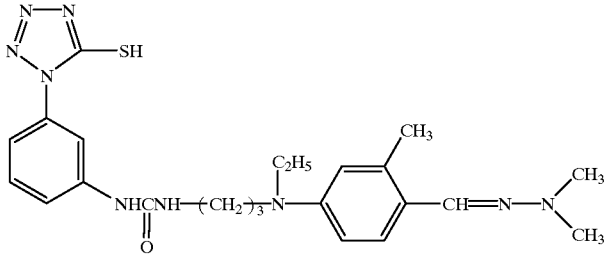
13.
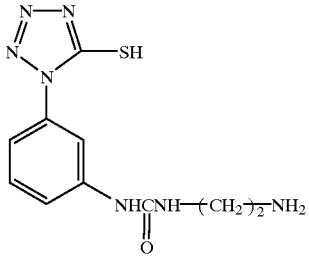
14.
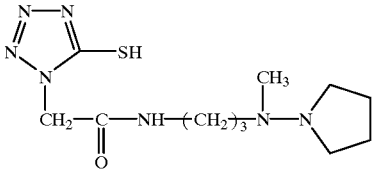

-continued
15.
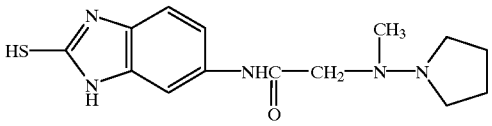
16.
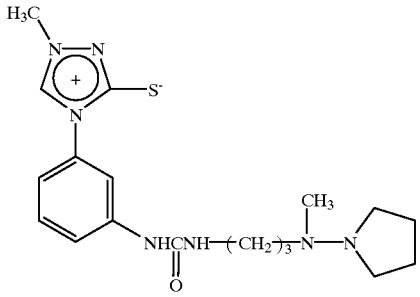
17.
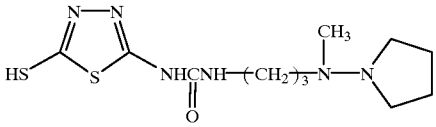
18.
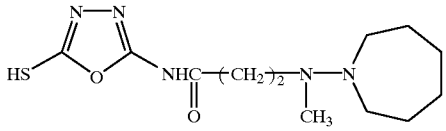
19.
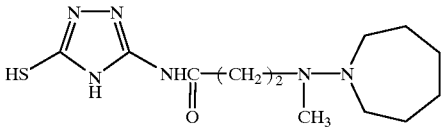
20.
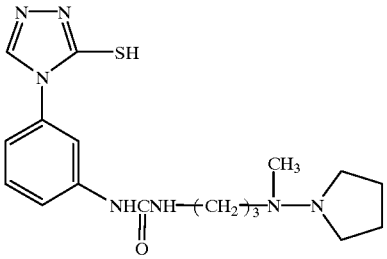
21.
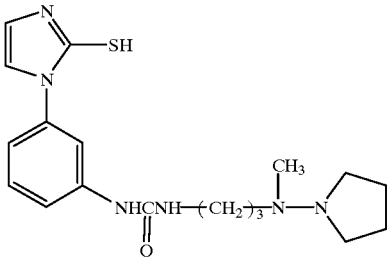
22.
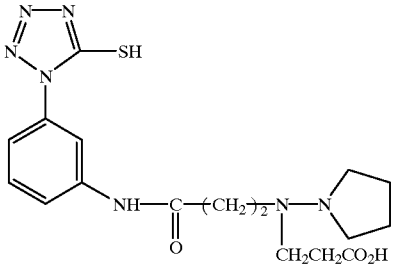
23.
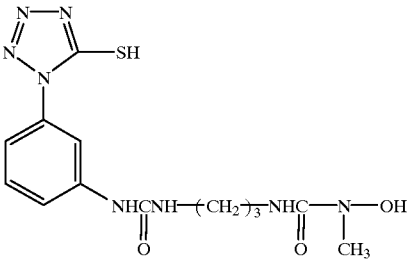
24.
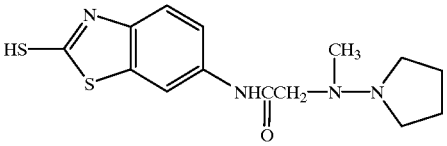
25.
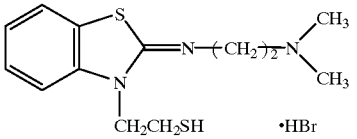
26.
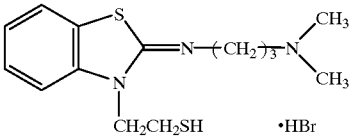
27.
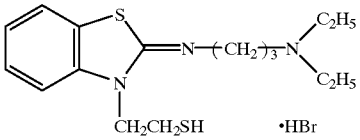
28.
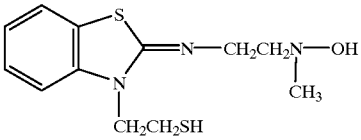

-continued
29.
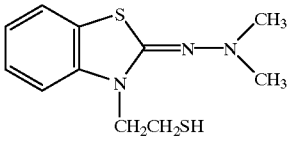
30.
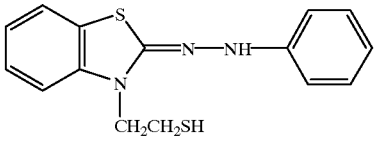
31.
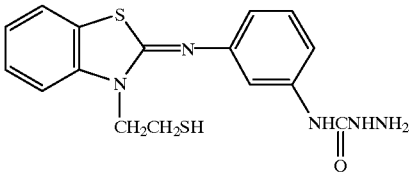
32.
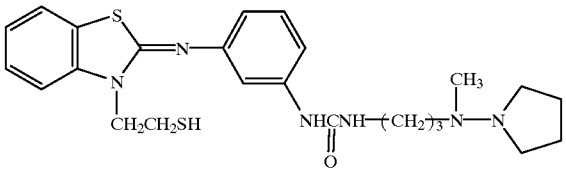
33.
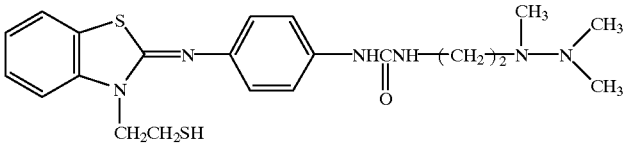
34.
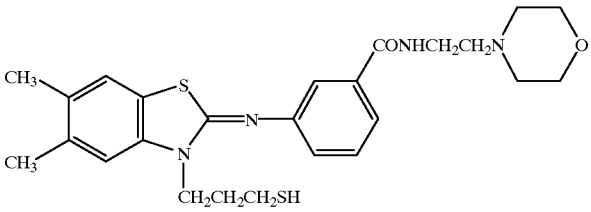
35.
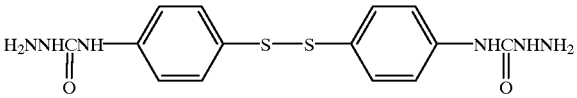
36.
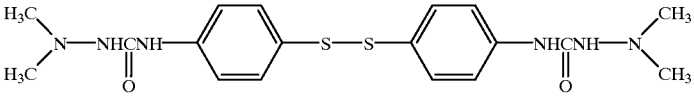
37.
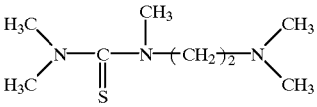
38.
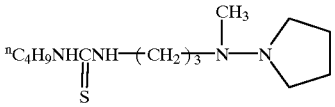
39.
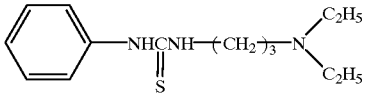
40.
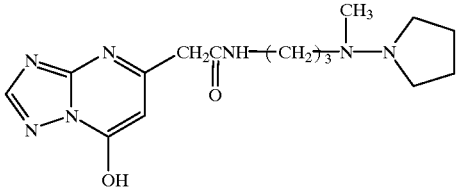
41.
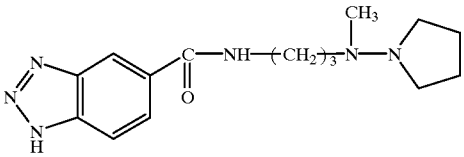
42.
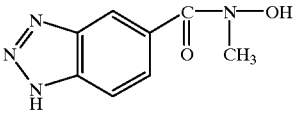

-continued
43.
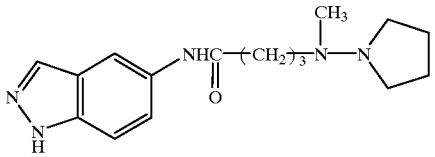
44.
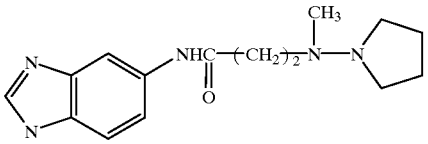
45.
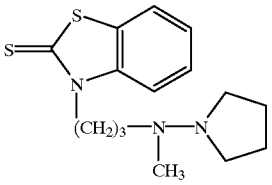
46.
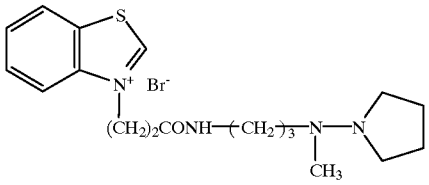
47.
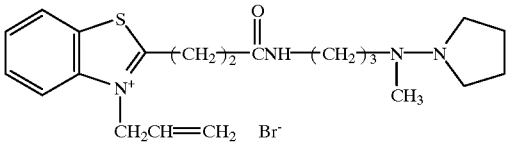
48.
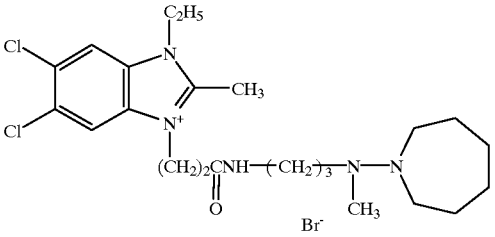
49.
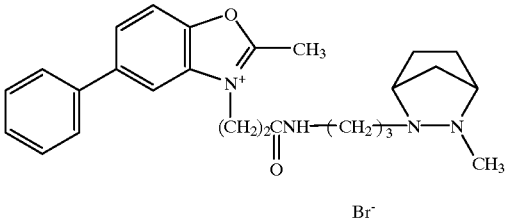
50.
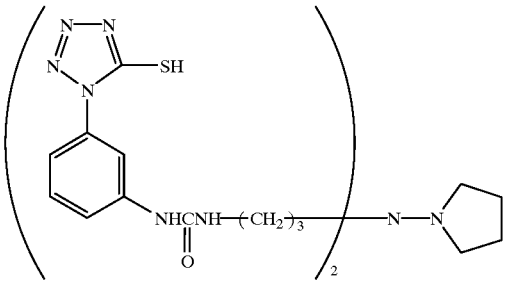
51.
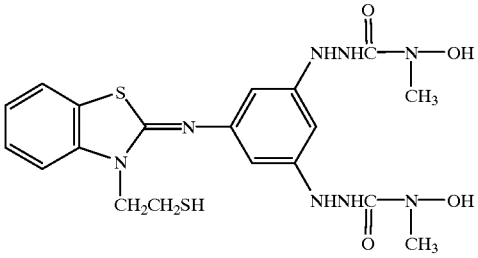
52.
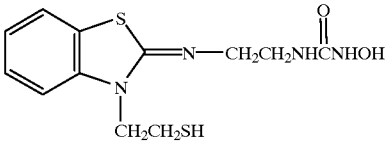
53.
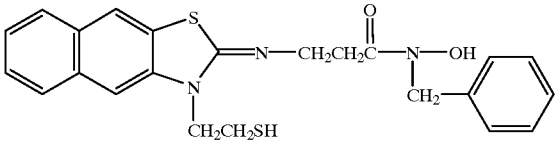
54.
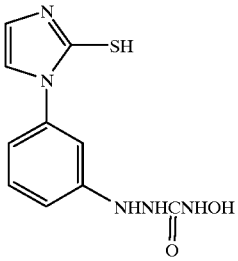
55.
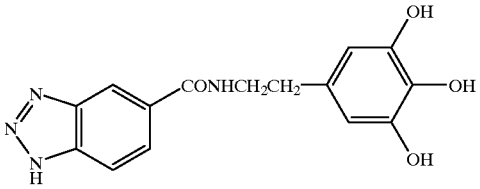

-continued

56.

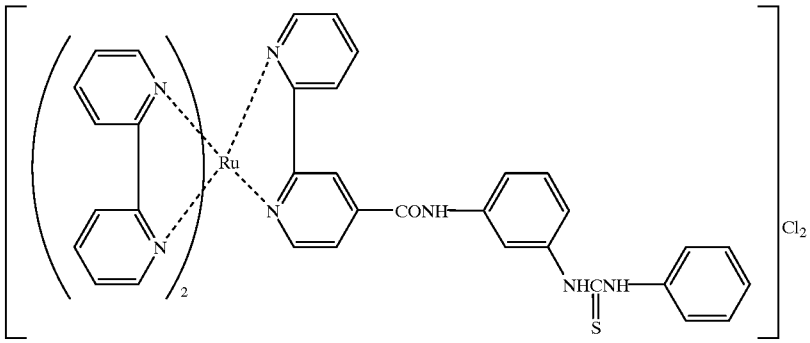

57.

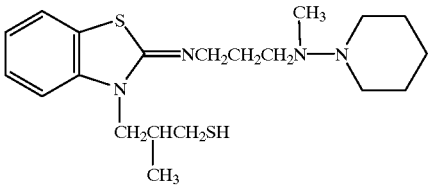

58.

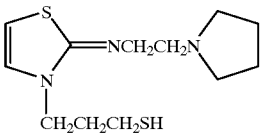

59.

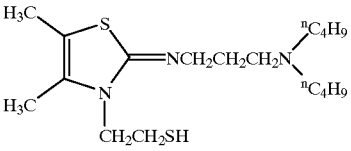

60.

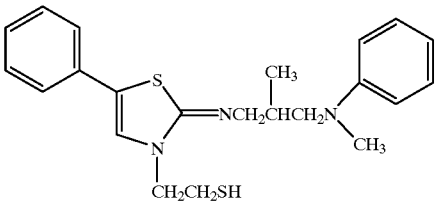

The aforementioned exemplary compounds may be ones in tautomerism therewith.

The adsorption promoting group to silver halide represented by X in the compound of formula (I) is described in the following patents and can be synthesized as taught therein.

| | | |
|---|---|---|
| JP-B | | |
| 2829/1964 | 18709/1964 | 22067/1964 |
| 22068/1964 | 4136/1968 | 4941/1968 |
| 10256/1968 | 13496/1968 | 22190/1970 |
| 17513/1971 | 34675/1971 | 4417/1972 |
| 5315/1972 | 8725/1972 | 30206/1972 |
| 18257/1973 | 32367/1973 | 34166/1973 |
| 35372/1973 | 38418/1973 | 322112/1973 |
| 8334/1974 | 40665/1975 | 25340/1976 |
| 28084/1978 | 9939/1983 | 95728/1983 |
| 52414/1984 | | |
| JP-A | | |
| 39039/1973 | 47335/1973 | 14120/1974 |
| 120628/1974 | 6323/1975 | 43923/1975 |
| 87028/1975 | 104927/1975 | 48723/1978 |
| 59463/1980 | 79436/1980 | 14836/1982 |
| 22234/1982 | 96331/1982 | 116340/1982 |
| 135945/1982 | 164734/1982 | 202531/1982 |
| 211142/1982 | 158631/1983 | 217928/1983 |
| 221839/1983 | 15240/1984 | 26731/1984 |
| 34530/1984 | 68732/1984 | 123838/1984 |
| 137951/1984 | 87322/1985 | 117240/1985 |
| 122936/1985 | 130731/1985 | 138548/1985 |

-continued

| | | |
|---|---|---|
| USP | | |
| 887,009 | 1,399,449 | 1,472,845 |
| 2,759,908 | 2,895,827 | 3,114,637 |
| 3,128,185 | 3,137,578 | 3,140,178 |
| 3,148,066 | 3,148,067 | 3,157,509 |
| 3,202,512 | 3,220,839 | 3,228,770 |
| 3,236,652 | 3,266,897 | 3,295,981 |
| 3,300,312 | 3,310,405 | 3,312,552 |
| 3,386,831 | 3,396,023 | 3,420,670 |
| 3,443,951 | 3,449,126 | 3,503,936 |
| 3,512,982 | 3,535,115 | 3,544,336 |
| 3,576,638 | 3,598,602 | 3,615,616 |
| 3,622,340 | 3,630,745 | 3,642,481 |
| 3,655,391 | 3,671,255 | 3,759,901 |
| 3,813,249 | 3,841,878 | 3,844,788 |
| 3,900,321 | 3,909,268 | 3,910,791 |
| 3,910,792 | 3,915,710 | 3,954,478 |
| 4,003,746 | 4,418,140 | |
| UKP | | |
| 948,422 | 952,162 | 965,047 |
| 972,211 | 1,021,199 | 1,064,805 |
| 1,065,669 | 1,129,623 | 1,161,264 |
| 1,165,075 | 1,246,311 | 1,249,077 |
| 1,269,268 | 1,287,284 | 1,290,868 |
| 1,344,525 | 1,308,777 | 1,347,544 |
| 1,387,654 | 1,389,089 | 1,394,371 |
| 1,402,819 | 1,459,160 | |
| German Patent | 1,107,508 | 1,447,796 |
| French Patent | | |
| 1,351,234 | 1,467,510 | 2,005,204 |
| 2,015,456 | 2,093,209 | |

-continued

| | | |
|---|---|---|
| Belgian Patent | | |
| 671,402 | 681,359 | 737,809 |
| OLS | | |
| 1,962,605 | 2,031,314 | 2,205,029 |
| 2,217,153 | 2,501,261 | 2,553,127 |
| DAS 1,772,424 | | |

Research Disclosure No. 13651

With respect to the synthesis of $L_1$ and D moieties and reaction to form X—$L_1$ and $L_1$—D bonds, reference should be made to the literature regarding organic synthetic reaction, for example, Japanese Chemical Society Ed., New Experimental Chemistry Series No. 14, Synthesis and Reaction of Organic Compounds, Vol. I to V, Maruzene, Tokyo, 1977, Yoshiro Ogata, "The Theory of Organic Reaction," Maruzene, Tokyo, 1962, and L. F. Fieser and M. Fieser, Reagents for Organic Synthesis, vol. 1 to 17, Wiley-Interscience, J. March, Advanced Organic Chemistry, Wiley-Interscience. The synthesis reaction is exemplified by the following Synthesis Examples 1 to 8.

The synthesis of compounds of formula (I) is described below.

Synthesis Example 1

Synthesis of Compound 1

To a stirred solution of 2.50 g (0.050 mol) of hydrazine monohydrate in 10 ml of acetonitrile under a nitrogen atmosphere at room temperature, 3.13 g (0.010 mol) of phenyl [3-(5-mercaptotetrazol-1-yl)phenyl]-carbamate was added in divided portions. After 2 hours of agitation, the precipitated solid was filtered and recrystallized from methanol, yielding 1.83 g (0.0073 mol) of the end compound.

Yield 73%; m.p. 165–166° C. (decomposition).

Synthesis Example 2

Synthesis of Compound 3

To a mixture of 5.0 g (0.016 mol) of phenyl [3-(5-mercaptotetrazol-1-yl)phenyl]-carbamate, 2.9 g (0.035 mol) of 2-methylimidazole, and 50 mol of acetonitrile was added 2.8 g (0.018 mol) of N-methyl-N-pyrrolidin-1-yl-propane-1,3-diamine. The mixture was heated under reflux for 30 minutes in a nitrogen atmosphere. After water cooling, the precipitated solid was filtered and boiled with 100 ml of methanol for 30 minutes for washing. The solution was allowed to cool down and the crystals were collected by filtration, obtaining 4.0 g (0.0106 mol) of the end compound.

Yield 66%; m.p. 196–198° C.

Synthesis Example 3

Synthesis of Compound 40

To a mixture of 3.4 g (0.017 mol) of (7-hydroxy-[1,2,4]triazolo[1,5-a]pyrimidin-5-yl)-acetic acid, 3.0 g (0.019 mol) of N-methyl-N-pyrrolidin-1-yl-propane-1,3-diamine, and 25 ml of dimethylformamide was added 3.6 g (0.017 mol) of dicyclohexylcarbodiimide. The mixture was heated and stirred for 3 hours at an external temperature of 45° C. The reaction mixture was allowed to stand overnight at room temperature. The precipitated solid was filtered and the solvent was distilled off from the filtrate under vacuum. Ethanol was added to the residue and ethyl acetate was added to the solution for crystallization. This operation was repeated five times. The resulting crystal was collected by filtration, obtaining 1.74 g (0.0052 mol) of the end compound.

Yield 31%; m.p. 95–97° C.

Synthesis Example 4

Synthesis of Compound 25

A mixture of 5.48 g (0.020 mol) of 2,3-dihydrothiazole-[2,3-b]benzothiazolium bromide, 1.76 g (0.020 mol) of N,N-dimethylethylenediamine, and 70 ml of 2-propanol was stirred for 6 hours at 50° C. The mixture was cooled to room temperature and the precipitated solid was collected by filtration. Recrystallization from ethanol yielded 5.0 g (0.0138 mol) of the end compound.

Yield 69%; m.p. 168–169° C.

Synthesis Example 5

Synthesis of Compound 26

A mixture of 5.48 g (0.020 mol) of 2,3-dihydrothiazole-[2,3-b]benzothiazolium bromide, 2.04 g (0.020 mol) of N,N-dimethyl-1,3-propanediamine, and 40 ml of 2-propanol was stirred for 5 hours at 80° C. The mixture was cooled to room temperature and the precipitated solid was collected by filtration. Recrystallization from ethanol yielded 3.95 g (0.0105 mol) of the end compound.

Yield 53%; m.p. 144–146° C.

Synthesis Example 6

Synthesis of Compound 27

A mixture of 5.48 g (0.020 mol) of 2,3-dihydrothiazole-[2,3-b]benzothiazolium bromide, 2.60 g (0.020 mol) of N,N-dimethyl-1,3-propanediamine, and 50 ml of methanol was stirred for 8 hours at 50° C. The mixture was cooled to room temperature and the precipitated solid was collected by filtration. Recrystallization from 2-propanol/n-hexane yielded 6.30 g (0.0156 mol) of the end compound.

Yield 78%; m.p. 143–145° C.

Synthesis Example 7

Synthesis of Compound 35

Synthesis was performed according to the following scheme 1.

Scheme 1

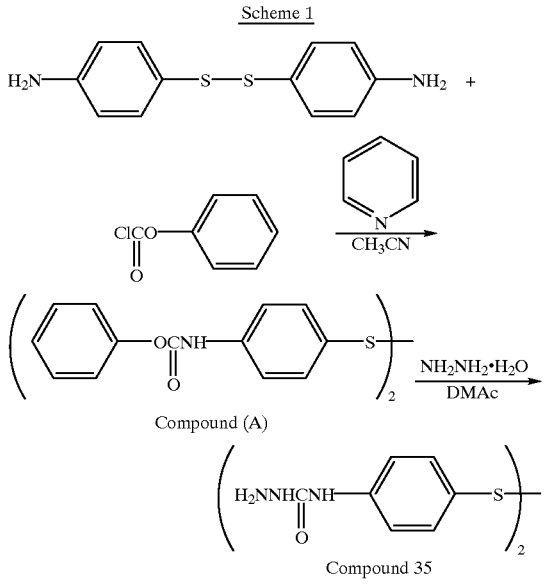

A solution of 12.4 g (0.050 mol) of 4,4-dithiodianiline in 100 ml of acetonitrile was ice cooled below 5° C. In a nitrogen atmosphere, 7.78 mol (0.10 mol) of pyridine was added to the solution and then, 15.7 g (0.10 mol) of phenyl chloroformate was slowly added dropwise such that the temperature of the reaction mixture might not exceed 10° C. After the completion of addition, the reaction mixture was stirred for 30 minutes below 5° C. and then for 2 hours at room temperature. The precipitated solid was collected by filtration and washed with acetonitrile, yielding 23.2 g (0.0475 mol) of Compound (A).

In 25 ml of dimethylacetamide (DMAc) was dissolved 12.2 g (0.025 mol) of Compound (A). With stirring at room temperature, 10.0 g (0.20 mol) of hydrazine monohydrate was added dropwise. The mixture was stirred for one hour at room temperature whereupon ice water was added. The precipitated solid was collected by filtration, washed with water, and recrystallized from dimethylformamide/methanol, obtaining 6.10 g (0.0167 mol) of Compound 35.

Yield 67%; m.p. 208–209° C.

Synthesis Example 8

Synthesis of Compound 36

In 25 ml of dimethylacetamide was dissolved 13.3 g (0.0272 mol) of Compound (A) prepared in Synthesis Example 7. With stirring at room temperature, 12.0 g (0.20 mol) of N,N-dimethylhydrazine was added dropwise. The mixture was stirred for 24 hours at room temperature whereupon water was added. The mixture was extracted with ethyl acetate. The organic layer was washed with a saturated sodium chloride aqueous solution and dried over anhydrous magnesium sulfate. The product was purified by silica gel column chromatography by eluting with ethyl acetate and a 95/5 (by volume) mixture of ethyl acetate/methanol, yielding 6.0 g (0.0143 mol) of Compound 36 as an oily matter.

Yield 53%.

The compound of the general formula (I) according to the invention may be added to either a photosensitive layer or a non-photosensitive layer, preferably a photosensitive layer.

The compound of formula (I) is added in a supersensitizing amount, typically in an amount of at least $10^{-4}$ mol per mol of silver. (The amount of the compound added per mol of silver is simply expressed in mol/Ag, hereinafter.) The amount of the compound added is preferably $10^{-3}$ to 1 mol/Ag, more preferably $10^{-3}$ to 0.3 mol/Ag, further preferably $10^{-3}$ to 0.1 mol/Ag although the amount varies depending on the desired purpose of addition such as supersensitization. The compounds of formula (I) may be used alone or in admixture of two or more.

As mentioned above, the photothermographic material of the invention contains the compound of formula (I), especially the compound of formula (II). Among the compounds of formula (I), the compounds of formula (II) are novel. These novel compounds can be used not only in photothermographic materials, but also in general photographic silver halide photosensitive materials. The use of the novel compounds in photographic silver halide photosensitive materials ensures high sensitivity in the red to infrared region, especially the practically advantageous infrared region and suppresses a change of photographic performance under different developing conditions.

Now the invention is described as being applied to a photothermographic system because the photographic silver halide photosensitive material of the invention is preferably a photothermographic photosensitive material.

Preferably the photothermographic material of the invention has a photosensitive layer containing photosensitive silver halide grains on one major surface of a support and a backing layer on the other major surface of the support. The photothermographic material has a first outer surface on the photosensitive layer-bearing side and a second outer surface remote from the photosensitive layer with respect to the support. In one preferred embodiment, the coefficient of dynamic friction between the first and second outer surfaces is 0.01 to 0.25, more preferably 0.1 to 0.25. The coefficient of dynamic friction ($\mu$) is determined by placing the first and second outer surfaces in close plane contact under a certain weight (a), measuring a force (b) necessary to move one surface relative to the other at a predetermined speed, and dividing the force (b) by the weight (a), that is, $\mu$=b/a.

In a further preferred embodiment, the coefficient of static friction between the first and second outer surfaces is 1.5 to 5 times greater than the coefficient of dynamic friction. The coefficient of static friction is preferably 0.25 to 0.5. The coefficient of static friction is determined by affixing a weight to the second outer surface, placing the second outer surface in close plane contact with the first outer surface, gradually inclining the assembly, and measuring the angle of inclination when the weight starts to move down.

According to the invention, the coefficient of friction may be adjusted using matte agents, surfactants, oil, and other addenda.

The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-$\alpha$-methylstyrene copolymers, polystyrene, styrene-divinylbenzene copolymers, polyvinyl acetate, polyethylene carbonate, and polytetrafluoro-ethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary.

No particular limit is imposed on the size and shape of the matte agent. The matte agent used herein may have any desired shape, for example, spherical and irregular shapes. The matte agent of any particle size may be used although matte agents having a particle size of about 0.1 $\mu$m to 30 $\mu$m, especially about 0.3 to 15 $\mu$m are preferably used in the practice of the invention. The particle size distribution of the matte agent may be either narrow (so-called monodisperse) or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

The amount of the matte agent added is preferably about 5 to 200 mg/m$^2$, more preferably about 10 to 150 mg/m$^2$ although the exact addition amount varies with a particular application of the photothermographic material.

In the photothermographic material of the invention, the matte agent may be added to any desired layer. Preferably the matte agent is added to an outermost surface layer, a layer functioning as an outermost surface layer or a layer close to the outer surface, and especially a layer functioning as a so-called protective layer.

In the practice of the invention, the matte agent may be used not only for adjusting a coefficient of friction, but also for improving surface luster, feed and anti-sticking properties.

The backing layer should preferably have a degree of matte as expressed by a Bekk smoothness of 10 to 250 seconds, more preferably 50 to 180 seconds. The emulsion surface may have any degree of matte insofar as no star dust failures occur although a Bekk smoothness of 300 to 10,000 seconds, especially 500 to 10,000 seconds is preferred.

The surfactants used herein may be nonionic, anionic or cationic and fluorinated ones. Examples include fluorinated polymer surfactants as described in JP-A 170950/1987 and U.S. Pat. No. 5,380,644, fluorinated surfactants as described in JP-A 244945/1985 and 188135/1988, polysiloxane surfactants as described in U.S. Pat. No. 3,885,965, and polyalkylene oxide and anionic surfactants as described in JP-A 301140/1994. The surfactant may be used not only for adjusting a coefficient of dynamic friction, but also for improving coating and electric charging properties.

Preferred examples of the oil used herein include silicone fluids such as silicone oil and silicone grease and hydrocarbon oils such as wax.

The photothermographic material has one or more layers on the support. At least one layer should contain a photosensitive silver halide capable of functioning as a photocatalyst. The photosensitive silver halide may be a photosensitive silver halide-forming component to be described later. Preferably the one layer further contains an organic silver salt as a reducible silver source, a developing or reducing agent, a binder and other optional additives such as toners, coating aids and other aids. Where two layers are provided, a first photosensitive layer which is generally a layer disposed adjacent to the support should contain an organic silver salt and silver halide and a second photosensitive layer or both the layers contain other components. Also contemplated herein is a two layer arrangement consisting of a single photosensitive layer containing all the components and a protective top coat. In the case of multicolor sensitive photothermographic material, a combination of such two layers may be employed for each color. Also a single layer may contain all necessary components as described in U.S. Pat. No. 4,708,928. In the case of multidye, multi-color sensitive photothermographic material, photosensitive layers are distinctly supported by providing a functional or non-functional barrier layer therebetween as described in U.S. Pat. No. 4,460,681.

A sensitizing dye is used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), *ibid.*, Item 1831 X (August 1979, page 437) and the references cited therein.

It is advantageous to select a sensitizing dye having appropriate spectral sensitivity to the spectral properties of a particular light source of various laser imagers, scanners, image setters and printing plate-forming cameras. Exemplary dyes for spectral sensitization to red light include compounds I-1 to I-38 described in JP-A 18726/1979, compounds I-1 to I-35 described in JP-A 75322/1994, and compounds I-1 to I-34 described in JP-A 287338/1995 for He-Ne laser light sources and dyes 1 to 20 described in JP-B 39818/1980, compounds I-1 to I-37 described in JP-A 284343/1987, and compounds I-1 to I-34 described in JP-A 287338/1995 for LED light sources.

In particular, silver halide grains are spectrally sensitized at any wavelength region in the range of 750 to 1,400 nm. More specifically, photosensitive silver halide can be spectrally advantageously sensitized with various known dyes including cyanine, merocyanine, styryl, hemicyanine, oxonol, hemioxonol and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, UKP 1,466,201, 1,469,117, and 1,422,057, JP-B 10391/1991 and 52387/1994, JP-A 341432/1993, 194781/1994, and 301141/1994. Especially preferred dye structures are cyanine dyes having a thioether bond, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, and Publication of International Patent Application No. 500926/1995.

These sensitizing dyes may be used alone or in admixture of two or more. A combination of sensitizing dyes is often used for the purpose of supersensitization. In addition to the sensitizing dye as well as the compound of formula (I), the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

Illustrative, non-limiting examples of the sensitizing dye which is used herein are given below.

D-1
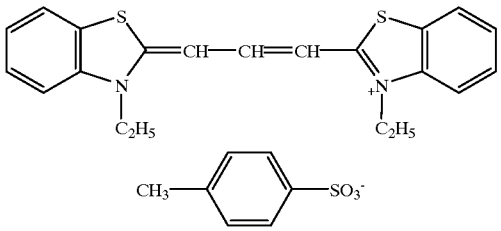
D-2
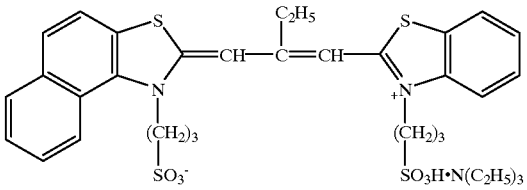
D-3
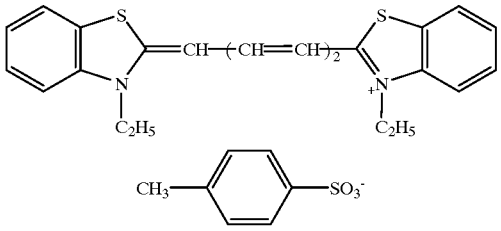
D-4
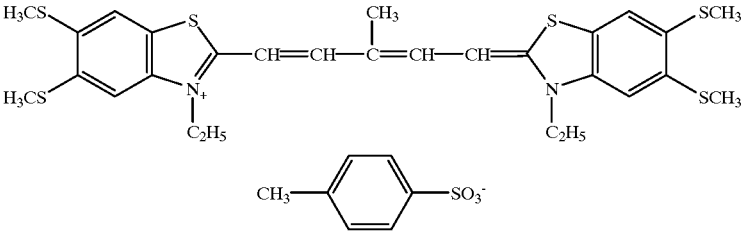
D-5
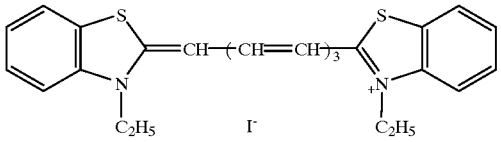
D-6
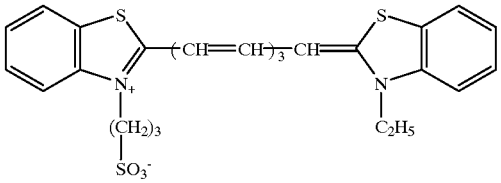
D-7
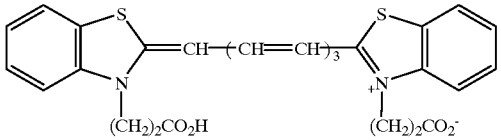
D-8
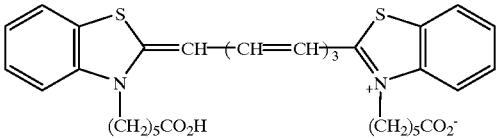
D-9
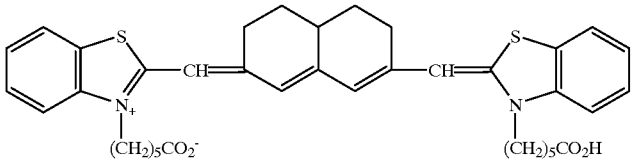
D-10
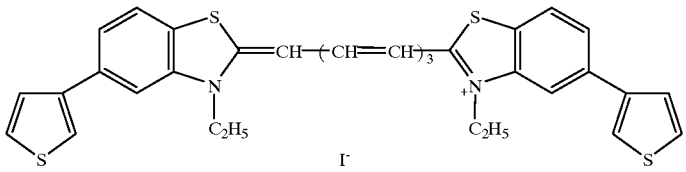

-continued
D-11
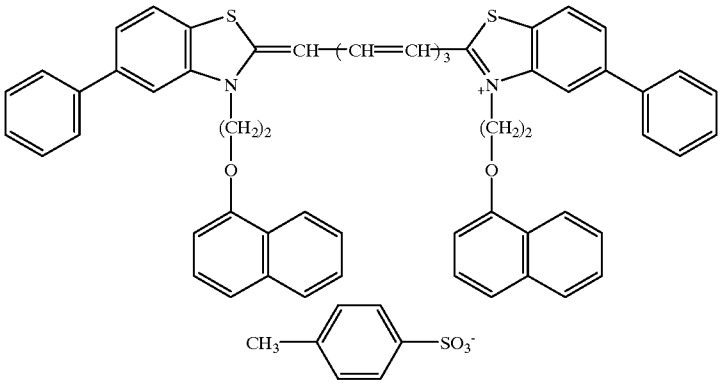
D-12
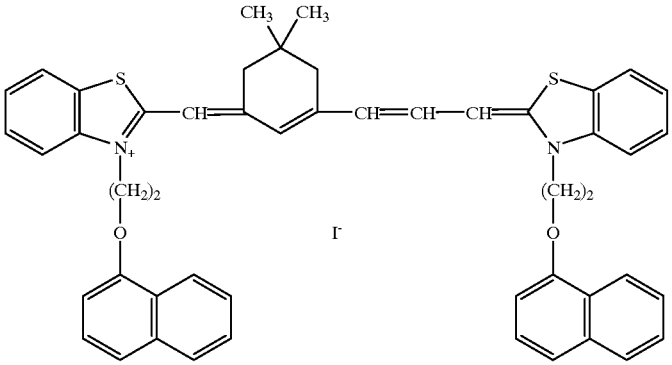
D-13
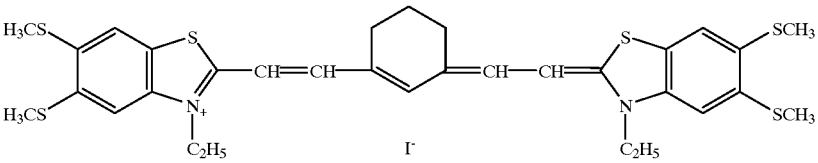
D-14
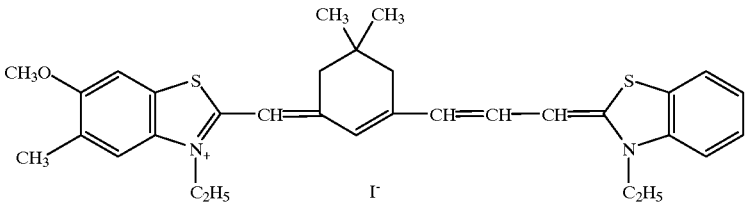
D-15
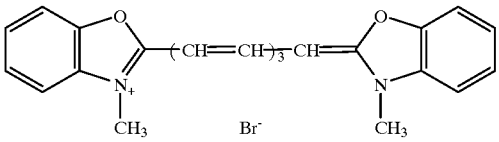
D-16
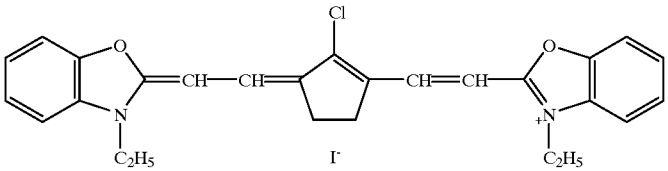

-continued

D-17

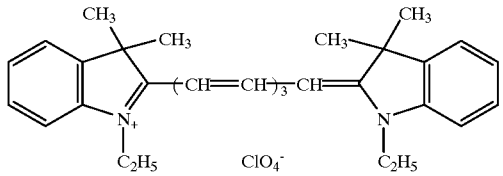

D-18

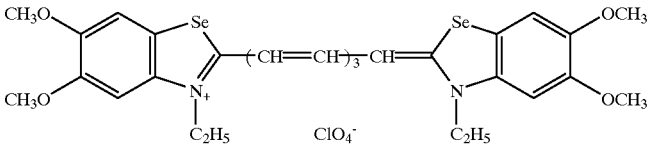

D-19

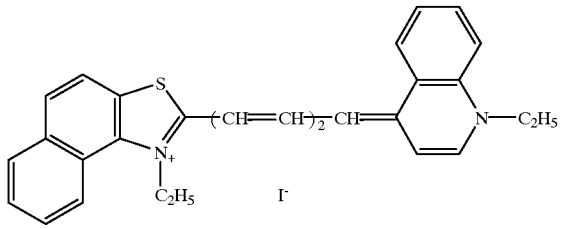

D-20

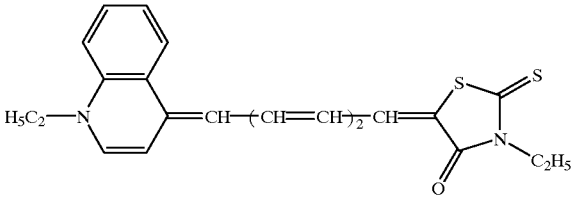

D-21

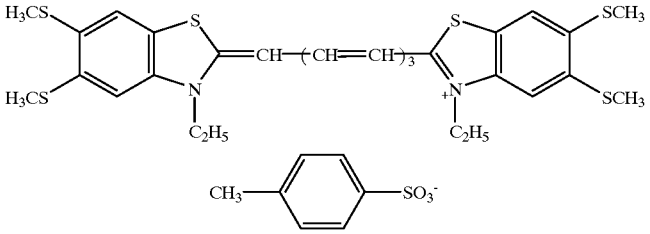

D-22

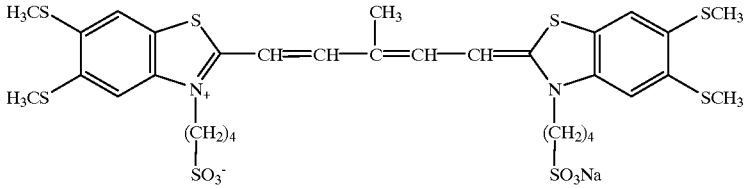

The amount of the sensitizing dye added is preferably about $10^{-6}$ to 1 mol, more preferably $10^{-5}$ to $10^{-1}$ mol, most preferably $10^{-4}$ to $10^{-1}$ mol per mol of the silver halide.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been acknowledged effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

A method for forming a photosensitive silver halide is well known in the art. Any of the methods disclosed in Research Disclosure No. 17029 (June 1978) and U.S. Pat. No. 3,700,458, for example, may be used. Illustrative methods which can be used herein are a method of adding a halogen-containing compound to a pre-formed organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller grain size for the purpose of minimizing white turbidity after image formation. Specifically, the grain size is less than 0.20 $\mu$m, preferably 0.01 $\mu$m to 0.15 $\mu$m, most preferably 0.02 $\mu$m to 0.12 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. An appropriate content of the metal complex is $1\times10^{-9}$ to $1\times10^{-2}$ mol, more preferably $1\times10^{-8}$ to $1\times10^{-4}$ mol per mol of silver. Illustrative metal complex structures are those described in JP-A 225449/1995. Preferred among cobalt and iron complexes are hexacyano metal complexes. Illustrative, non-limiting examples of cobalt and iron complexes include hexacyano metal complexes such as ferricyanate, ferrocyanate, and hexacyanocobaltate ions. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocycles, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds.

Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding a preformed photosensitive silver halide at any timing during preparation of an organic silver salt. Any desired mixing method may be used insofar as the benefits of the invention are fully achievable.

The organic acid silver used herein is a silver salt which is relatively stable to light, but forms a silver image when heated at 80° C. or higher in the presence of an exposed photocatalyst (as typified by a latent image of photosensitive silver halide) and a reducing agent. The organic acid silver may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 30% by weight of an image forming layer. Preferred organic acid silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

In the practice of the invention, silver salts of compounds having a mercapto or thion group and derivatives thereof may also be used as the organic silver salt along with the organic acid silver. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thion as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. The inverse proportional relationship between the size of silver salt crystal grains and their covering power that is well known for photosensitive silver halide materials also applies to the photothermographic material of the present invention. That is, as organic silver salt grains constituting image forming regions of photothermographic material increase in size, the covering power becomes smaller and the image density becomes lower. It is thus necessary to reduce the grain size. In the practice of the invention, grains should preferably have a minor axis of 0.01 μm to 0.20 μm, more preferably 0.01 μm to 0.15 μm and a major axis of 0.10 μm to 5.0 μm, more preferably 0.10 μm to 4.0 μm. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the auto-correlation function of the fluctuation of scattering light relative to a time change, and obtaining the grain size (volume weighed mean diameter) therefrom.

The organic silver salt is used in any desired amount, preferably in such an amount as to provide a coverage of 0.1 to 5 grams, especially 1 to 3 grams per square meter of the photosensitive material.

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 1 to 10% by weight of an image forming layer. In a multilayer embodiment wherein the reducing agent is added to a layer other than an emulsion layer, the reducing agent should preferably be contained in a slightly higher amount of about 2 to 15% by weight of that layer.

For photothermographic materials using organic silver salts, a wide range of reducing agents are disclosed. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2-dihydroxy-1,1-binaphthyl, 6,6-dibromo-2,2-dihydroxy-1,1-binaphthyl, and bis(2-hydroxy-1-naphthyl)methane; combinations of bis-β-naphthols with 1,3-dihydroxybenzene derivatives such as 2,4-dihydroxybenzophenone and 2,4-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols, with the bisphenols being especially preferred.

It is sometimes advantageous to use an additive known as a "toner" for improving images in addition to the above-mentioned components. The toner is used in an amount of 0.1 to 10% by weight of the entire silver-carrying components. The toners are compounds well known in the photographic art as shown in U.S. Pat. Nos. 3,080,254, 3,847,612 and 4,123,282.

Examples of the toner include phthalimide and N-hydroxyphthalimide; cyclic imides such as succinimide, pyrazoline-5-ones, quinazoline, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl) phthalazinone, 6-chlorophthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, and tetrachlorophthalic anhydride); phthalazine, phthalazine derivatives or metal salts, or derivatives such as 4-(1-naphthyl) phthlazine, 6-chlorophthalazine, 5,7-dimethoxyphthalazine and 2,3-dihydrophthlazine; combinations of phthalazine with phthalic acid derivatives (e.g., phthalic acid, 4-methylphthalic acid, 4-nitrophthalic acid, and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asymtriazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

In the thermographic material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar-SM and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

A surface protective layer may be provided in the photosensitive material according to the present invention for the purpose of preventing adhesion of an image forming layer. The surface protective layer may be formed of any adhesion-preventing material. Examples of the adhesion-preventing material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the emulsion layer or a protective layer therefor according to the invention, there may be used light absorbing substances and filter dyes as described in U.S. Pat. Nos. 3,253,921, 2,274,782, 2,527,583, and 2,956,879. The dyestuffs may be mordanted as described in U.S. Pat. No. 3,282,699. The filter dye is preferably used in such an amount as to provide an absorbance of 0.1 to 3, especially 0.2 to 1.5 at the exposure wavelength.

The emulsion layer is based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:2, more preferably from 8:1 to 1:1.

In one preferred embodiment, the photothermographic material of the invention is a one-side photosensitive material having at least one photosensitive (or emulsion) layer containing a silver halide emulsion on one surface and a backing layer on the other surface of the support.

In the practice of the invention, the binder used in the backing layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water to form a dispersion which is coated to form a layer.

The backing layer preferably exhibits a maximum absorbance of 0.3 to 2 in the desired wavelength range, more preferably an absorbance of 0.5 to 2 in the IR range and 0.001 to less than 0.5 in the visible range for IR exposure. Further preferably, the backing layer is an anti-halation layer having an optical density of 0.001 to less than 0.3.

Where anti-halation dyestuffs are used in the practice of the invention, such a dyestuff may be any compound which has desired absorption, exhibits sufficiently low absorption in the visible region and provides the backing layer with a preferred absorbance spectrum profile. Exemplary anti-halation dyes are the compounds described in JP-A 13295/1995, U.S. Pat. No. 5,380,635, JP-A 68539/1990, page 13, lower-left column to page 14, lower-left column, and JP-A 24539/1991, page 14, lower-left column to page 16, lower-right column though not limited thereto.

A backside resistive heating layer as described in U.S. Pat. Nos. 4,460,681 and 4,374,921 may be used in a thermographic imaging system according to the present invention.

Still further, the photothermographic material of the invention may contain a benzoic acid type compound for the purposes of increasing sensitivity and preventing fog. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the photosensitive material, preferably to a layer on the same side as the photosensitive layer, more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably 1 $\mu$mol to 2 mol, more preferably 1 mmol to 0.5 mol per mol of silver.

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in UKP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 120328/1975, 121332/1976, 58022/1979, 70543/1981, 99335/1981, 90842/1984, 129642/1986, 129845/1987, 208191/1994, 5621/1995, 2781/1995, 15809/1996, U.S. Pat. Nos. 5,340,712, 5,369,000, and 5,464,737.

In the photosensitive layer, polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in UKP 955,061 may be added as a plasticizer and lubricant.

According to the invention, a hardener may be used in various layers including a photosensitive emulsion layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

Hydrazine derivatives may be used in the present invention. Typical hydrazine derivatives used herein are compounds of the general formula (I) described in Japanese Patent Application No. 47961/1994, specifically compounds I-1 to I-53 described therein.

Other hydrazine derivatives are also preferred. Exemplary hydrazine derivatives include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; and the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group forming an intramolecular hydrogen bond with the hydrogen atom of hydrazine described in Japanese Patent Application No. 191007/1995, specifically the compounds of the general formulae (A), (B), (C), (D), (E), and (F), more specifically compounds N-1 to N-30 described therein; and the compounds of the general formula (1) in Japanese Patent Application No. 191007/1995, more specifically compounds D-1 to D-55 described therein.

Hydrazine nucleating agents are used by dissolving in suitable water-miscible organic solvents such as alcohols (e.g., methanol, ethanol, propanol, and fluorinated alcohols), ketones (e.g., acetone and methyl ethyl ketone), dimethylformamide, dimethylsulfoxide, and methyl cellosolve.

A well-known emulsifying dispersion method is used for dissolving the hydrazine derivative with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine nucleating agent may be added to a silver halide emulsion layer on a support or any hydrophilic colloid layer on the same side, preferably to the silver halide emulsion layer or a hydrophilic colloid layer disposed adjacent thereto.

An appropriate amount of the nucleating agent is 1 $\mu$mol to 10 mmol, more preferably 10 $\mu$mol to 5 mmol, most preferably 20 $\mu$mol to 5 mmol per mol of silver halide.

Though not essential, it is sometimes advantageous to add a mercury (II) salt to the emulsion layer as an antifoggant. The mercury (II) salts preferred to this end are mercury acetate and mercury bromide.

According to the invention, the photothermographic emulsion may be coated on a variety of supports. Typical supports include polyester film, subbed polyester film, poly (ethylene terephthalate) film, polyethylene naphthalate film, cellulose nitrate film, cellulose ester film, poly(vinyl acetal) film, polycarbonate film and related or resinous materials, as well as glass, paper, metals, etc. Often used are flexible substrates, typically paper supports, specifically baryta paper and paper supports coated with partially acetylated $\alpha$-olefin polymers, especially polymers of $\alpha$-olefins having 2 to 10 carbon atoms such as polyethylene, polypropylene, and ethylene-butene copolymers. The supports are either transparent or opaque, preferably transparent.

The photosensitive material of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

A method for producing color images using the photothermographic material of the invention is as described in JP-A 13295/1995, page 10, left column, line 43 to page 11, left column, line 40. Stabilizers for color dye images are exemplified in UKP 1,326,889, U.S. Pat. Nos. 3,432,300, 3,698,909, 3,574,627, 3,573,050, 3,764,337, and 4,042,394.

In the practice of the invention, the photothermographic emulsion can be coated by various coating procedures including dip coating, air knife coating, flow coating, and extrusion coating using a hopper of the type described in U.S. Pat. No. 2,681,294. if desired, two or more layers may be concurrently coated by the methods described in U.S. Pat. No. 2,761,791 and UKP 837,095.

In the photothermographic material of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate member.

The photosensitive material of the invention may be developed by any desired method although it is generally developed by heating after imagewise exposure. The preferred developing temperature is about 80 to 250° C., more preferably 100 to 140° C. and the preferred developing time is about 1 to 180 seconds, more preferably about 10 to 90 seconds.

Any desired technique may be used for the exposure of the photothermographic material of the invention. The preferred light source for exposure is a laser, for example, a gas laser, YAG laser, dye laser, and semiconductor laser. A semiconductor laser combined with a second harmonic generating device is also useful.

The photosensitive material of the invention may be packaged in any desired form. Preferably the photosensitive material takes the form of a sheet. Usually, the photosensitive material is cut into rectangular sheets having rounded corners and 50 to 1,000 sheets are grouped as a set and wrapped in a package. The package for wrapping the photothermographic material is made of a material whose percent absorption of light to which the photothermographic material is sensitive is higher than 99%, especially 99.9 to 100%.

EXAMPLE

Examples of the present invention are given below by way of illustration and not by way of limitation.

The trade names used in Examples have the following meaning.

Denka Butyral: polyvinyl butyral by Denki Kagaku Kogyo K.K. BUTVAR: polyvinyl butyral by Monsanto Co. Megafax F-176P: fluorinated surfactant by Dai-Nihon Ink Chemical Industry K.K.

CAB 171-15S and 381-20: cellulose acetate butyrate by Eastman Chemical Products, Inc.

Sildex H31, H51 and H121: spherical silica by Dokai Chemical K.K.

Sumidur N3500: polyisocyanate by Sumitomo-Bayern Urethane K.K.

Example 1

Preparation of Silver Halide Grains

In 700 ml of water were dissolved 23 grams of phthalated gelatin and 30 mg of potassium bromide. The solution was adjusted to pH 5.1 at a temperature of 35° C. To the solution, 159 ml of an aqueous solution containing 18.6 grams of silver nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 grams of silver nitrate and an aqueous solution containing 11 μmol/liter of dipotassium hexachloroiridate and 1 mol/liter of potassium bromide were added over 30 minutes by the controlled double jet method while maintaining the solution at pAg 7.7. The pH of the solution was lowered to cause flocculation and sedimentation for desalting. The solution was adjusted to pH 5.9 and pAg 8.2 by adding 0.1 gram of phenoxyethanol. There were obtained silver iodobromide grains in the form of cubic grains having an iodine content of 8 mol % in the core and 2 mol % on the average, a mean grain size of 0.06 μm, a coefficient of variation of projected area of 8%, and a (100) face proportion of 89%.

The thus obtained silver halide grains were heated at 60° C., to which 90 μmol of sodium thiosulfate, 10 μmol of 2,3,4,5,6-pentafluorophenyldiphenylphosphine selenide, 12 μmol of tellurium compound 1, 4 μmol of chloroauric acid, and 280 μmol of thiocyanic acid were added per mol of silver. The solution was ripened for 120 minutes and quenched to 30° C., obtaining a silver halide emulsion.

Preparation of Organic Acid Silver Emulsion

A mixture of 1.3 grams of stearic acid, 0.5 gram of arachidic acid, 8.5 grams of behenic acid, and 300 ml of distilled water was stirred at 90° C. for 15 minutes. With vigorous stirring, 31.1 ml of 1N NaOH aqueous solution was added over 15 minutes to the solution, which was cooled to 32° C. 7 ml of 1N phosphoric acid aqueous solution was added to the solution. With more vigorous stirring, 0.12 gram of N-bromosuccinimide was added to the solution and the above-prepared silver halide emulsion was added in such an amount as to give 2.5 mmol of silver halide. Further, 25 ml of 1N silver nitrate aqueous solution was added over 2 minutes and stirring was continued for 90 minutes. The solids were separated by suction filtration and washed with water until the water filtrate reached a conductivity of 30 μS/cm. To the thus obtained solids was added 37 grams of a 1.2 wt % butyl acetate solution of polyvinyl acetate, followed by agitation. Agitation was stopped and the reaction mixture was allowed to stand whereupon it separated into an oil layer and an aqueous layer. The aqueous layer was removed together with salts contained therein. To the oil layer was added 20 grams of a 2.5 wt % 2-butanone solution of polyvinyl butyral (Denka Butyral #3000-K), followed by agitation. Then 0.11 mmol of pyridinium bromide perbromide and 0.14 mmol of calcium bromide dihydrate were added thereto together with 0.7 gram of methanol, and 40 grams of 2-butanone and 7.8 grams of polyvinyl butyral (BUTVAR® B-76) were further added. The mixture was dispersed by means of a homogenizer, obtaining an organic acid silver salt emulsion of needle grains having a mean minor diameter of 0.04 μm, mean major diameter of 1.4 μm and a coefficient of variation of 28%.

Preparation of Emulsion Layer Coating Solution

Various chemicals were added to the above-prepared organic acid silver salt emulsion in amounts per mol of silver. With stirring at 28° C., 9 mg of sodium phenylthiosulfonate, 70 mg of dye 1 (identical with D-21 exemplified above), 32 mg of dye 2 (identical with D-8 exemplified above), 15.4 mmol of a compound of formula (I) reported in Table 1 (omitted in sample No. 101 and replaced by comparative compounds in sample Nos. 102, 103 and 104), 23 grams of 4-chlorobenzophenone-2-carboxylic acid, 580 grams of 2-butanone, and 220 grams of dimethylformamide were added to the emulsion, which was allowed to stand for 3 hours. With stirring, there were further added 7.6 grams of 5-tribromomethylsulfonyl-2-methylthiadiazole, 6 grams of 2-tribromomethylsulfonylbenzothiazole, 4.8 grams of 4,6-ditrichloromethyl-2-phenyltriazine, 2 grams of disulfide compound 1, 150 grams of 1,1-bis(2-hydroxy-3,5-dimethylphenyl)-3,5,5-trimethylhexane, 1 gram of Megafax F-176P, 590 grams of 2-butanone, and 10 grams of methyl isobutyl ketone.

Emulsion Surface Protective Layer Coating Solution

A coating solution was prepared by dissolving 75 grams of CAB 171-15S, 5.9 grams of 4-methylphthalic acid, 1.5 grams of tetrachlorophthalic anhydride, 5.5 grams of tetrachlorophthalic acid, 13 grams of phthalazine, 0.3 gram of Megafax F-176P, 1.5 grams of Sildex H31 (spherical silica having a mean particle size of 3 μm), and 6 grams of Sumidur N3500 in 3,070 grams of 2-butanone and 30 grams of ethyl acetate.

Back Layer Coating Solution

Calcium compound 1 was synthesized by adding 167 ml of an aqueous solution containing 0.019 mol of calcium chloride and 125 ml of 25% aqueous ammonia to 1 liter of an ethanol solution containing 0.08 mol of 3,5-di-tert-butylcatechol, and blowing air into the solution for 3 hours at room temperature. There were precipitated crystals of bis[2-(3,5-di-tert-butyl-o-benzoquinonemonoimine)-4,6-di-tert-butylphenolato]calcium (II).

A back layer coating solution was prepared by adding 12 grams of polyvinyl butyral (Denka Butyral #4000-2), 12 grams of CAB 381-20, 140 mg of dyestuff 1, 300 mg of calcium compound 1, 300 mg of dyestuff 2, 4 mg of dyestuff 3, 0.4 gram of Sildex H121 (spherical silica having a mean particle size 12 μm), 0.4 gram of Sildex H51 (spherical silica having a mean particle size 5 μm), 0.15 gram of Megafax F-176P, and 2 grams of Sumidur N3500 to 500 grams of 2-butanone and 500 grams of 2-propanol and stirring the mixture for dissolving the components.

Preparation of Coated Sample

Onto one surface of a 175-μm thick polyethylene terephthalate support tinted with a blue dyestuff, the emulsion layer coating solution prepared above was coated so as to provide a coverage of 2.3 g/m$^2$ of silver. The back layer coating solution was then coated on the opposite surface of the support so as to provide an optical density of 0.7 at 810 nm. Further, the emulsion surface protective layer coating solution was coated onto the emulsion layer to a dry thickness of 2 μm. A series of photosensitive materials were obtained in this way (see Table 1).

The tellurium compound 1, disulfide compound 1, dyes 1 and 2, dyestuffs 1, 2 and 3, and blue dyestuff have the structures shown below.

tellurium compound 1
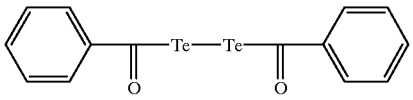
disulfide compound 1
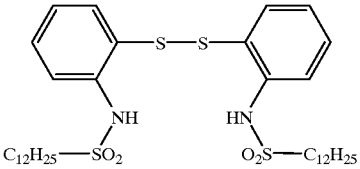
dye 1
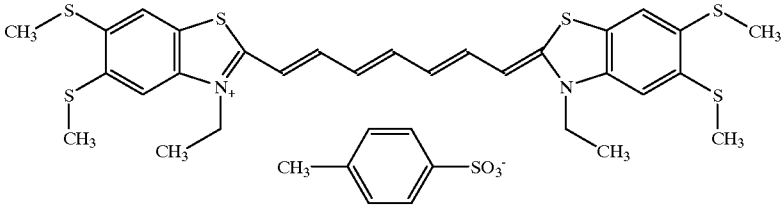
dye 2
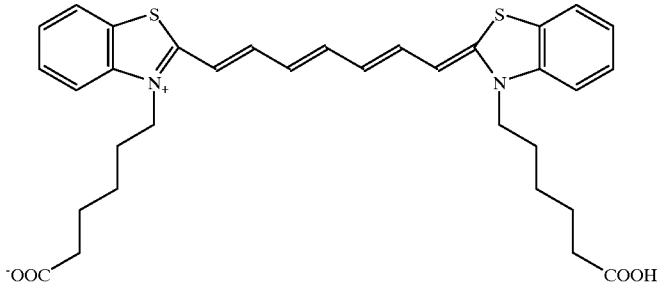
dyestuff 1
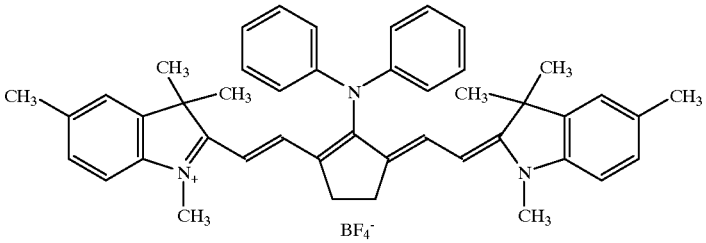
blue dyestuff
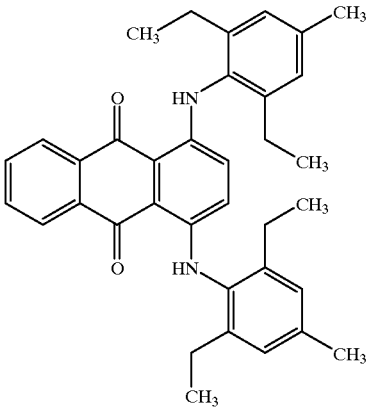

-continued dyestuff 2

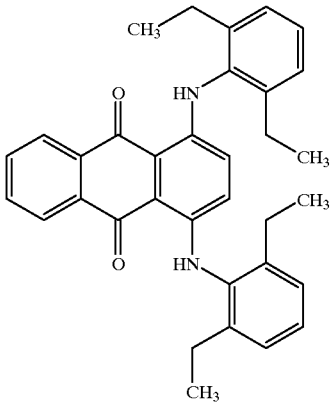

dyestuff 3

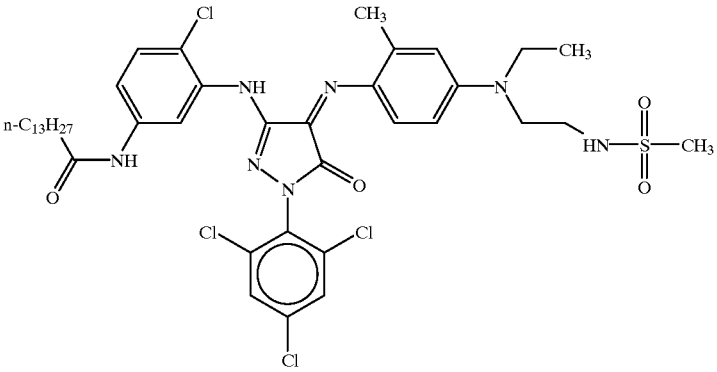

The thus obtained photothermographic photosensitive material samples were examined by the following test.

Evaluation of Photographic Properties

A photothermographic material sample was exposed to a 830-nm laser beam from a laser diode at an angle of 13° with respect to a vertical plane. Using a heat drum, the sample was heated at 115° C. for 15 seconds or at 120° C. for 15 seconds for heat development. The resulting image was measured for sensitivity (S) by means of a densitometer. Note that the sensitivity is the inverse of a ratio of the exposure dose providing a density of Dmin+0.3, and it is expressed in a relative value based on a sensitivity of 100 for No. 101 which was developed 120° C.×15s. A sensitivity difference (ΔS) between different developing temperatures is determined as follows.

$$\Delta S = S(120^\circ\ C.\times 15s) - S(115^\circ\ C.\times 15s)$$

The results are shown in Table 1.

TABLE 1

| Sample | | Relative sensitivity | | |
|---|---|---|---|---|
| No. | Compound | 115° C. × 15s | 120° C. × 15s | ΔS |
| 101* | — | 80 | 100 | 20 |
| 102* | Compound W | 78 | 105 | 27 |
| 103* | Compound X | 88 | 102 | 14 |
| 104* | Compound Y | 102 | 120 | 18 |
| 105 | Compound 1 | 179 | 184 | 5 |

TABLE 1-continued

| Sample | | Relative sensitivity | | |
|---|---|---|---|---|
| No. | Compound | 115° C. × 15s | 120° C. × 15s | ΔS |
| 106 | Compound 2 | 181 | 185 | 4 |
| 107 | Compound 3 | 180 | 185 | 5 |
| 108 | Compound 4 | 179 | 184 | 5 |
| 109 | Compound 5 | 180 | 184 | 4 |
| 110 | Compound 12 | 175 | 181 | 6 |
| 111 | Compound 15 | 180 | 184 | 4 |
| 112 | Compound 17 | 176 | 181 | 5 |
| 113 | Compound 20 | 180 | 185 | 5 |
| 114 | Compound 25 | 185 | 188 | 3 |
| 115 | Compound 26 | 186 | 188 | 2 |
| 116 | Compound 27 | 186 | 189 | 3 |
| 117 | Compound 31 | 182 | 186 | 4 |
| 118 | Compound 41 | 170 | 176 | 6 |
| 119 | Compound 46 | 168 | 175 | 7 |

*outside the scope of the invention

Comparative compounds W, X, and Y are shown below.

comparative compound W (described in JP-A 4241/1990)

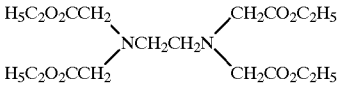

comparative compound X (described in JP-A 341432/1993)

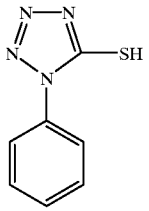

comparative compound Y

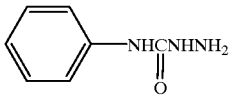

It is evident from Table 1 that the samples using comparative compounds have a low sensitivity and experience a marked change of sensitivity with a change of developing temperature whereas the samples using compounds of formula (I) having an adsorption promoting group and an electron donative group within a common molecule according to the invention have a higher sensitivity and experience a less change of sensitivity with a change of developing temperature.

Example 2

Preparation of Organic Acid Silver Emulsion

To 12 liters of water were added 840 grams of behenic acid and 95 grams of stearic acid. To the solution kept at 90° C., a solution of 48 grams of sodium hydroxide and 64 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 34° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a 1.2 wt % butyl acetate solution of polyvinyl acetate was added to the aqueous mixture. The mixture was allowed to stand for 10 minutes, separating into two layers. After the aqueous layer was removed, the remaining gel was washed three times with water. There was obtained a gel-like mixture of silver behenate, silver stearate, and silver bromide, which was dispersed in 1,800 grams of a 2.6% isopropyl alcohol solution of polyvinyl butyral (Denka Butyral #3000-K). The dispersion was further dispersed in 600 grams of polyvinyl butyral (Denka Butyral #4000-2) and 300 grams of isopropyl alcohol, obtaining an organic acid silver salt emulsion of needle grains having a mean minor diameter of 0.04 μm, a mean major diameter of 1.2 μm, and a coefficient of variation of 30%.

Preparation of Emulsion Layer Coating Solution

Various chemicals were added to the above-prepared organic acid silver salt emulsion in amounts per mol of silver. With stirring at 25° C., 10 mg of sodium phenylthiosulfonate, 70 mg of dye A (identical with D-22 exemplified above), 12.4 mmol of a compound of formula (I) reported in Table 2 (omitted in sample No. 201 and replaced by comparative compounds in sample Nos. 202, 203 and 204), 26 grams of 4-chlorobenzophenone-2-carboxylic acid, 580 grams of 2-butanone, and 220 grams of dimethylformamide were added to the emulsion, which was allowed to stand for 3 hours. With stirring, there were further added 8 grams of 5-tribromomethylsulfonyl-2-methylthiadiazole, 6 grams of 2-tribromomethylsulfonylbenzothiazole, 5 grams of 4,6-ditrichloromethyl-2-phenyltriazine, 2 grams of disulfide compound A, 180 grams of 1,1-bis(2-hydroxy-3,5-dimethylphenyl)-3,5,5-trimethylhexane, 5.5 grams of tetrachlorophthalic acid, 12 grams of phthalazine, 3 grams of a hydrazine derivative A, 1.1 grams of Megafax F-176P, 590 grams of 2-butanone and 10 grams of methyl isobutyl ketone.

Emulsion Surface Protective Layer Coating Solution

A coating solution was prepared by dissolving 75 grams of CAB 171-15S, 5.7 grams of 4-methylphthalic acid, 1.5 grams of tetrachlorophthalic anhydride, 0.3 grams of Megafax F-176P, 2 grams of Sildex H31 (spherical silica having a mean particle size of 3 μm), and 7.2 grams of Sumidur N3500 in 3,070 grams of 2-butanone and 30 grams of ethyl acetate.

Back Layer Coating Solution

A back layer coating solution was prepared by adding 6 grams of polyvinyl butyral (Denka Butyral #4000-2), 0.2 gram of Sildex H121 (spherical silica having a mean particle size 12 μm), 0.2 gram of Sildex H51 (spherical silica having a mean particle size 5 μm), and 0.1 gram of Megafax F-176P to 64 grams of 2-propanol and stirring the mixture for dissolving the components. Further added to the solution were a solution containing 420 mg of dyestuff A in 10 grams of methanol and 20 grams of acetone and a solution containing 1.1 grams of 3-isocyanatomethyl-3,5,5-trimethylhexyl isocyanate in 7 grams of ethyl acetate.

Preparation of Coated Sample

The support used was a polyethylene terephthalate film having moisture-proof subbing layers of vinylidene chloride on opposite surfaces. The back layer coating solution was coated on the back surface of the support so as to provide an optical density of 0.7 at 633 nm. The emulsion layer coating solution prepared above was coated to the opposite surface of the support so as to provide a coverage of 2 g/m$^2$ of silver. The emulsion surface protective layer coating solution was coated onto the emulsion layer to a dry thickness of 2 μm, obtaining a series of thermographic photosensitive material samples.

The dye A, disulfide compound A, hydrazine derivative A, and dyestuff A have the following structure.

hydrazine derivative A

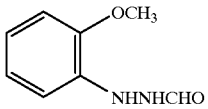

dye A

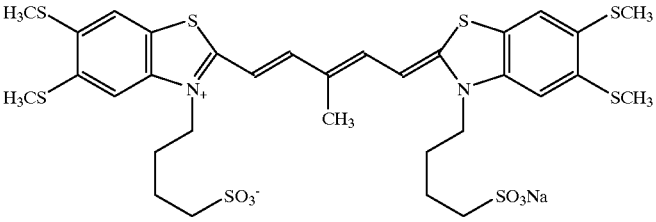

disulfide compound A

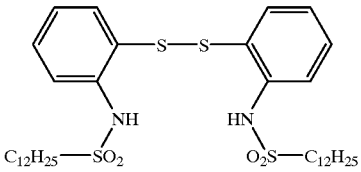

dyestuff A

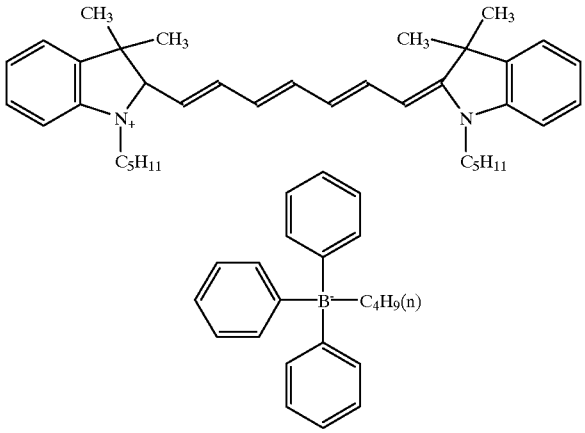

The thus obtained photothermographic photosensitive material samples were examined by the following test.

Evaluation of Photographic Properties

A photothermographic material sample was exposed by means of a 633-nm He—Ne laser sensitometer and heated at 115° C. for 15 seconds or at 115° C. for 20 seconds for heat development. The developed sample was exposed to a halide lamp for 15 seconds to decolorize the dyestuff in the backing layer. The resulting image was measured for minimum density (Dmin), sensitivity (S) and gradation (γ) by means of a densitometer. Note that the sensitivity is the inverse of a ratio of the exposure dose providing a density of Dmin+3.0, and it is expressed in a relative value based on a sensitivity of 100 for No. 201 which was developed at 115° C.×20s. Also note that γ is the gradient of a straight line connecting points of density 0.3 and 3.0 on a characteristic curve. A sensitivity difference (ΔS) and gradation difference (Δγ) between different developing temperatures are determined as follows.

$$\Delta S = S(115^\circ\ C.\times 20s) - S(115^\circ\ C.\times 15s)$$

$$\Delta\gamma = \gamma(115^\circ\ C.\times 20s) - \gamma(115^\circ\ C.\times 15s)$$

The results are shown in Table 2.

TABLE 2

| Sample | | Relative sensitivity | | | Gradient | | |
|---|---|---|---|---|---|---|---|
| No. | Compound | 115° C. × 15 s | 115° C. × 20 s | ΔS | 115° C. × 15 s | 115° C. × 20 s | Δγ |
| 201* | — | 74 | 100 | 26 | 2 | 5 | 3 |
| 202* | Compound W | 75 | 102 | 27 | 3 | 6 | 3 |
| 203* | Compound X | 77 | 103 | 26 | 3 | 6 | 3 |
| 204* | Compound Y | 98 | 121 | 23 | 3 | 6 | 3 |
| 205* | Compound Z | 112 | 140 | 28 | 10 | 13 | 3 |

TABLE 2-continued

| Sample | | Relative sensitivity | | | Gradient | | |
|---|---|---|---|---|---|---|---|
| No. | Compound | 115° C. × 15 s | 115° C. × 20 s | ΔS | 115° C. × 15 s | 115° C. × 20 s | Δγ |
| 206 | Compound 1 | 181 | 188 | 7 | 11 | 12 | 1 |
| 207 | Compound 3 | 182 | 188 | 6 | 12 | 13 | 1 |
| 208 | Compound 5 | 180 | 187 | 7 | 12 | 13 | 1 |
| 209 | Compound 18 | 178 | 186 | 8 | 10 | 12 | 2 |
| 210 | Compound 25 | 184 | 189 | 5 | 13 | 14 | 1 |
| 211 | Compound 26 | 185 | 189 | 4 | 13 | 14 | 1 |
| 212 | Compound 27 | 184 | 187 | 3 | 13 | 14 | 1 |
| 213 | Compound 40 | 176 | 185 | 9 | 9 | 11 | 2 |

*outside the scope of the invention

It is noted that comparative compounds W, X and Y in Table 2 are the same as in Table 1. Comparative compound Z is shown below.

Comparative compound Z (described in U.S. Pat. No. 3,924,955)

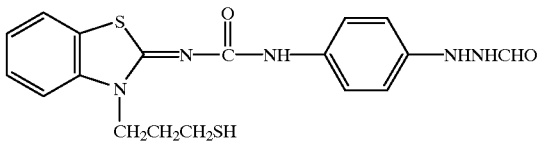

It is evident from Table 2 that the samples using comparative compounds have a low sensitivity and experience a marked change of photographic properties with a change of developing temperature whereas the samples using compounds of formula (I) having an adsorption promoting group and an electron donative group within a common molecule according to the invention have a higher sensitivity and contrast and experience a less change of photographic properties with a change of developing temperature.

There has been descried a photosensitive material comprising a specific compound of formula (I) which offers a higher sensitivity and contrast and experiences a less change of photographic properties under different developing conditions.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A photothermographic material comprising (a) a reducible silver source, (b) a photocatalyst, (c) a reducing agent, (d) a binder, and (e) at least one compound of the following formula (I-a):

(I-a)

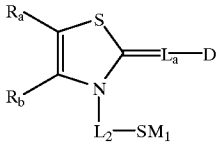

wherein D is an electron donative group of atoms represented by the following formula (D-1), (D-2) or (D-3):

(D-1)

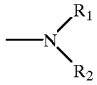

(D-2)

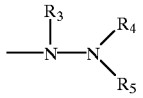

(D-3)

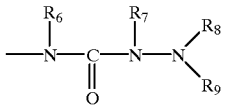

wherein each of $R_1$, $R_2$, $R_3$, $R_4$, $R_5$, $R_6$, $R_7$, $R_8$, and $R_9$ is a hydrogen, $C_{1-30}$ alkyl, $C_{2-30}$ alkenyl, $C_{2-30}$ alkynyl, $C_{6-20}$ aryl, or a 3- to 10-membered heterocyclic group, or $R_1$ and $R_2$, $R_3$ and $R_4$, $R_4$ and $R_5$, $R_6$ and $R_7$, $R_7$ and $R_8$, and $R_8$ and $R_9$, taken together, may form a 5- to 8-membered nitrogenous heterocyclic ring, or $R_3$ and $R_4$ or $R_4$ and $R_5$, taken together, may form a ring which is 2,3-diazabicyclo[2.2.1]heptane, or $R_4$ and $R_5$, taken together, may form a ring which is an azepane or azokane;

$L_a$ is a =N— combined with a $C_{2-6}$ alkylene, $L_2$ is a $C_{2-6}$ alkylene group, each of $R_a$ and $R_b$ is selected from the group consisting of hydrogen, $C_{1-20}$ alkyl, $C_{2-20}$ alkenyl, $C_{2-20}$ alkynyl, $C_{6-30}$ aryl, $C_{0-20}$ amino, $C_{1-20}$ alkoxy, $C_{6-20}$ aryloxy, $C_{1-20}$ acyl, $C_{2-20}$ alkoxycarbonyl, $C_{7-20}$ aryloxy, $C_{2-20}$ acyloxy, $C_{2-20}$ acylamino, $C_{2-20}$ alkoxycarbonylamino, $C_{7-20}$ aryloxycarbonylamino, $C_{1-20}$ sulfonylamino, $C_{0-20}$ sulfamoyl, $C_{1-20}$ carbamoyl, $C_{1-20}$ alkylthio, $C_{6-20}$ arylthio, $C_{1-20}$ sulfonyl, $C_{1-20}$ sulfinyl, $C_{1-20}$ ureido, $C_{1-20}$ phosphoric amide, hydroxy, mercapto, halogen, cyano, sulfo, sulfino, carboxyl, phosphono, phosphino, nitro, hydroxamic acid, hydrazino, imino, imidazolyl, pyridyl, furyl, piperidyl and morpholino, or $R_a$ and $R_b$, may form a ring, taken together, selected from the group consisting of benzene, cyclopentene, cyclohexene, pyridine, pyrimidine, and pyrazole, and $M_1$ is a hydrogen atom or cation.

2. The photothermographic material of claim 1 wherein the reducible silver source (a) is an organic silver salt, and the photocatalyst (b) is a photosensitive silver halide and/or photosensitive silver halide-forming component.

3. The photothermographic material of claim 2 wherein the organic silver salt is a silver salt of an organic acid.

4. The photothermographic material of claim 1 wherein the reducing agent (c) is a bisphenol.

5. The photothermogaphic material of claim 1 wherein the photocatalyst (b) is spectrally sensitized in a wavelength region of 750 to 1,400 nm.

6. The photothermographic material of claim 1 further comprising (f) at least one hydrazine compound.

7. The photothermographic material of claim 1 wherein the compound of formula (I-a) is added in an amount of $10^{-3}$ to 0.1 mol per mol of silver.

8. The photothermographic material of claim 1, wherein the 5- to 8-membered nitrogenous heterocyclic ring is selected from the group consisting of pyrrolidine, piperidine, piperazine, morpholine, pyrroline, imidazoline, imidazolidine, pyrazolidine, pyrazoline, indoline, isoindoline, perhydroxyazepine and hexahydropyridazine.

9. The photothermographic material of claim 1, wherein said compounds of formula (I-a) are compounds of the following formula (I-b):

(I-b)

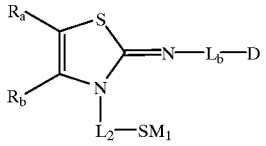

wherein D, $R_a$, $R_b$, $M_1$, and $L_2$ are as defined in formula (I-a)

and wherein $L_b$ is a linking group selected from the group consisting of $C_{2-6}$ alkylene and a combination thereof with —O—, —S—, —N($R_{03}$)—, —CO—, or —$SO_2$—, wherein $R_{03}$ is hydrogen, hydroxy, aliphatic hydrocarbon, aryl or heterocyclic group.

10. The photothermographic material of claim 9 wherein said compounds of formula (I-a) are compounds of the following formula (II):

(II)

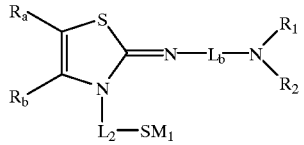

wherein $R_a$, $R_b$, $L_2$, $L_b$, $R_1$ and $R_2$ are defined in claim 9.

11. The photothermographic material of claim 10 wherein said compounds of formula (II) are compounds of the following formula (II-a):

(II-a)

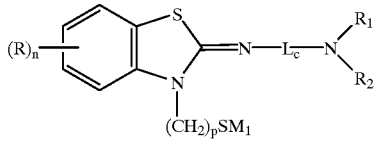

wherein $R_1$, $R_2$ and M1 are each defined in claim 10,

R is a monovalent substituent group selected from the group consisting of hydrogen, $C_{1-20}$ alkyl, $C_{2-20}$ alkenyl, $C_{2-20}$ alkynyl, $C_{6-30}$ aryl, $C_{0-20}$ amino, $C_{1-20}$ alkoxy, $C_{6-20}$ aryloxy, $C_{1-20}$ acyl, $C_{2-20}$ alkoxycarbonyl, $C_{7-20}$ aryloxy, $C_{2-20}$ acyloxy, $C_{2-20}$ acylamino, $C_{2-20}$ alkoxycarbonylamino, $C_{7-20}$ aryloxycarbonylamino, $C_{1-20}$ sulfonylamino, $C_{0-20}$ sulfamoyl, $C_{1-20}$ carbamoyl, $C_{1-20}$ alkylthio, $C_{6-20}$ arylthio, $C_{1-20}$ sulfonyl, $C_{1-20}$ sulfinyl, $C_{1-20}$ ureido, $C_{1-20}$ phosphoric amide, hydroxy, mercapto, halogen, cyano, sulfo, sulfino, carboxyl, phosphono, phosphino, nitro, hydroxamic acid, hydrazino, imino, imidazolyl, pyridyl, furyl, piperidyl and morpholino, $L_c$ is a $C_{2-6}$ alkylene group, n is an integer of 0 to 4, and p is an integer of 2 to 4.

* * * * *

UNITED STATES PATENT AND TRADEMARK OFFICE
CERTIFICATE OF CORRECTION

PATENT NO. : 6,120,983

DATED : September 19, 2000

INVENTOR(S): Hisashi OKADA et al.

It is certified that error appears in the above-identified patent and that said Letters Patent are hereby corrected as shown below:

In claim 11, line 5 (counting the formula as one line), change "M1" to -- $M_1$ --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*